US005623244A

United States Patent [19]

Cooper

[11] Patent Number: 5,623,244

[45] Date of Patent: Apr. 22, 1997

[54] PILOT VEHICLE WHICH IS USEFUL FOR MONITORING HAZARDOUS CONDITIONS ON RAILROAD TRACKS

[75] Inventor: Guy F. Cooper, Ventura, Calif.

[73] Assignee: The United States of America as represented by the Secretary of the Navy, Washington, D.C.

[21] Appl. No.: 709,590

[22] Filed: Sep. 9, 1996

Related U.S. Application Data

[63] Continuation-in-part of Ser. No. 644,464, May 10, 1996.

[51] Int. Cl.[6] ..... B60R 25/00

[52] U.S. Cl. ..... 340/425.5; 340/938; 246/166; 246/167 R

[58] Field of Search ..... 340/425.5, 938; 246/166, 167; 364/426.02, 551

[56] References Cited

U.S. PATENT DOCUMENTS

| | | | |
|---|---|---|---|
| 3,128,975 | 4/1964 | Heung-Duk Dan | 246/121 |
| 3,857,614 | 12/1974 | Kurichh | 303/118.1 |
| 4,076,003 | 2/1978 | Grabedian | 123/198 F |
| 4,302,746 | 11/1981 | Scarzello et al. | 340/938 |
| 4,578,665 | 3/1986 | Tai-Her Yang | 340/48 |
| 4,653,269 | 3/1987 | Johnson | 60/39.63 |
| 5,255,962 | 10/1993 | Neuhaus et al. | 303/188 |
| 5,295,551 | 3/1994 | Sukonick | 180/167 |
| 5,404,303 | 4/1995 | Pattantyus et al. | 364/426.02 |
| 5,429,329 | 7/1995 | Wallace et al. | 246/166 |
| 5,526,784 | 6/1996 | Hakkenberg et al. | 123/322 |
| 5,560,688 | 10/1996 | Schappler et al. | 303/3 |

*Primary Examiner*—Jeffery Hofsass
*Assistant Examiner*—Davetta Woods
*Attorney, Agent, or Firm*—David S. Kalmbaugh; Melvin J. Sliwka

[57] ABSTRACT

A self-propelled remotely controlled pilot vehicle adapted for use on railroad tracks to monitor hazardous conditions and obstacles on the railroad tracks. The pilot vehicle precedes a train along the railroad tracks at a distance which will allow the train to come to a complete stop in the event the pilot vehicle encounters a hazardous condition on the track. The pilot vehicle is equipped with a sensor array which measures a variety of different parameters such as the presence of noxious gases, moisture in the atmosphere or at ground level, breakage in one or both rails of the track and orientation with respect to the force of gravity as well as the yaw, pitch and roll of the tracks upon which the pilot vehicle is riding. The pilot vehicle is also equipped with a television camera which provides a visual image of the railroad track ahead of the pilot vehicle to the engineer of the train. An infrared camera which is mounted on the front of the pilot vehicle generates an infrared image of the tracks. Information gathered by the pilot vehicle's sensor array is supplied to a computer on board the pilot vehicle and is also transmitted to the train to enable the engineer to be apprised of conditions existing on the tracks ahead of the train in order to have time to react to dangerous situations on the railroad tracks.

20 Claims, 11 Drawing Sheets

PILOT VEHICLE WHICH IS USEFUL FOR MONITORING HAZARDOUS CONDITIONS ON RAILROAD TRACKS

This application is a continuation-in part of U.S. patent application Ser. No. 08/644,464, filed May 10, 1996.

BACKGROUND OF THE INVENTION

1. Field of the Invention

The present invention relates generally to the field of systems for monitoring hazardous conditions on railroad tracks. More specifically, the present invention relates to surveillance systems on board a pilot vehicle travelling ahead of a train which senses conditions including hazards existing on the tracks and then communicates with the train about these conditions.

2. Description of the Prior Art

As technology has developed, mankind has vastly increased his mobility. At one time, a horse-drawn chariot was the fastest mode of surface transportation available. Today, one can travel across the country by train at speeds in excess of 100 miles per hour.

Unfortunately, as speeds of trains increase, the potential danger from operating and riding on trains has also increased. The time which the operator of the train has to react to a potentially dangerous situation (such as an obstruction in the path of the train) decreases proportionally with the speed of the train. For this reason, the risk of a serious accident to personnel on board the train and the occurrence of these accidents increases dramatically. In addition, nearly any accident involving a train travelling at very high speeds (between 60 and 100 miles per hour) is likely to be a serious accident involving injury and even death to personnel on board the train.

Many potentially dangerous situations arise for trains travelling at high speeds on today's railroads. For example, railroad tracks, roadbed and bridges and other structures in the path of a train can be damaged by natural occurrences such as floods or landslides or man made occurrences such as sabotage of the track on which the train is travelling.

Stopped vehicles, such as a car, bus or truck stalled at a railway crossing or another train on the same track, can obstruct the track ahead of a rapidly moving train and are a serious and frequent problem for today's high speed trains. By the time the engineer of the rapidly moving train discovers the vehicle, there is generally an insufficient distance between the train and the vehicle for the engineer to safely bring the train to a complete stop and avoid the stalled vehicle. A collision between the rapidly moving train and the stalled vehicle will almost always result in a loss of life and substantial property damage.

Solutions to this problem have been proposed in the past. For example, U.S. Pat. No. 4,578,665 to Yang (issued Mar. 25, 1986) discloses a self-propelled remotely controlled satellite car which proceeds a train along train tracks. The satellite car is remotely controlled to travel a predetermined distance ahead of the train. The satellite car is equipped with a sensor array which measures a variety of different parameters such as sound level, temperature, the presence of noxious gases, moisture, orientation with respect to the direction of the force of gravity and vibration level. Information gathered by the satellite car is transmitted back to the train to enable the train engineer to be apprised of conditions existing on the tracks ahead of the train in order to have time to react to potential hazards. Position indicators disposed along the tracks transmit position information to the satellite car to permit the satellite car to correlate measured information with expected information. The satellite car and the train are linked by transmitters and receivers.

U.S. Pat. No. 3,128,975 to Dan (issued May 17, 1960) discloses a surveying system in which a detector assembly precedes a train on the same track at a remotely controlled distance ahead of the train. The detector assembly comprises a drive car and a driven car. The driven car is coupled to the drive car through a coupling arm which functions to hold a switch open. When the driven car encounters an obstacle the coupling is released initiating the sending of a danger signal and to stop the drive car.

While these pilot vehicles are satisfactory for their intended purpose of providing an indication to an engineer on a moving train of potentially dangerous situations or obstructions in path of the train, there is still a need to integrate today's state of the art technology into a pilot vehicle which is highly efficient, very reliable and relatively inexpensive to maintain and operate.

SUMMARY OF THE INVENTION

The present invention overcomes some of the disadvantages of the prior art including those mentioned above in that it comprises a highly efficient and very reliable pilot vehicle which precedes a train. The pilot vehicle of the present invention is a remotely controlled railroad vehicle for reducing the frequency of railway accidents. The pilot vehicle and the train to be protected travel rectilinearly along the same railway tracks. The pilot vehicle includes a propulsion device for propelling the pilot vehicle along the tracks. The propulsion device is controlled by an on board computer which maintains the satellite car at distance D ahead of the train which will allow the train to come to a safe stop in the event the pilot vehicle encounters a safety hazard or obstacle on the tracks.

The pilot vehicle's on board computer may also be remotely controlled by signals transmitted by a transmitter on board the train. Multiple sensing devices on board the pilot vehicle acquire information about the conditions existing on the tracks in proximity to the pilot vehicle and then transmit this information back to the train. The train receives and displays the transmitted information which is use by the train's engineer to determine if hazards or dangerous conditions exist on the tracks in front of the train.

The pilot vehicle's sensing devices include a noxious gas detector for detecting the presence of at least one of a plurality of gases in proximity to the pilot vehicle. The sensing devices also include a moisture detector disposed on the pilot vehicle a predetermined distance above the rails for detecting the presence of water. The sensing devices may include a television camera for monitoring the visual scene presented to the pilot vehicle as the pilot vehicle travels along the rails. The sensing devices may include an infrared camera for providing an infrared image of the scene ahead of the pilot vehicle as the pilot vehicle travels along the rails. The sensing devices may also include a variety of magnetic signature sensing systems which are positioned in close proximity with the rails of the track to sense and compare with pre-recorded data the strength of a magnetic field generated by low level currents induced in the rails of the track.

The sensing devices may include a magnetic rail analysis system which detects and records an induced response for each section of rail of the railroad tracks to a low strength alternating current magnetic field generated by the magnetic rail analysis system. The magnetic response detected by the magnetic rail analysis system is compared by the pilot vehicle's computer with a stored library of magnetic responses for each section of track on the route the pilot vehicle and the train are to traverse. Differences between the present magnetic response and the recorded magnetic response indicate a change in the structure of the section of track being sampled and thus possible damage to the track.

The pilot vehicle has a rail top reference tilt grid system which utilizes rail constrained car kinematics and a direction relative to the Earth's north to characterize attitude changes in the tracks upon which the pilot vehicle is riding. These attitude changes, which may be caused by partial washout, lateral earth slippage, land slides or natural phenomena, can indicate damage to the track's roadbed and thus the track upon which the pilot vehicle is riding. The pilot vehicle's rail constrained kinematics are measured by sensors, accelerometers, a gyro and other monitoring devices on board the pilot vehicle. The resultant data from the pilot vehicle's monitoring devices is processed by the on board computer to determine if there is damage to the track's roadbed.

The pilot vehicle also has a reaction jet stopping system which comprises a pair of pendular nozzles mounted on each side of the pilot vehicle. When activated each nozzle expels compressed air therethrough generating a thrust vector which brings the pilot vehicle to a complete stop in approximately one second.

DETAILED DESCRIPTION OF THE DRAWINGS

DETAILED DESCRIPTION OF THE PREFERRED EMBODIMENT

Figure 1:
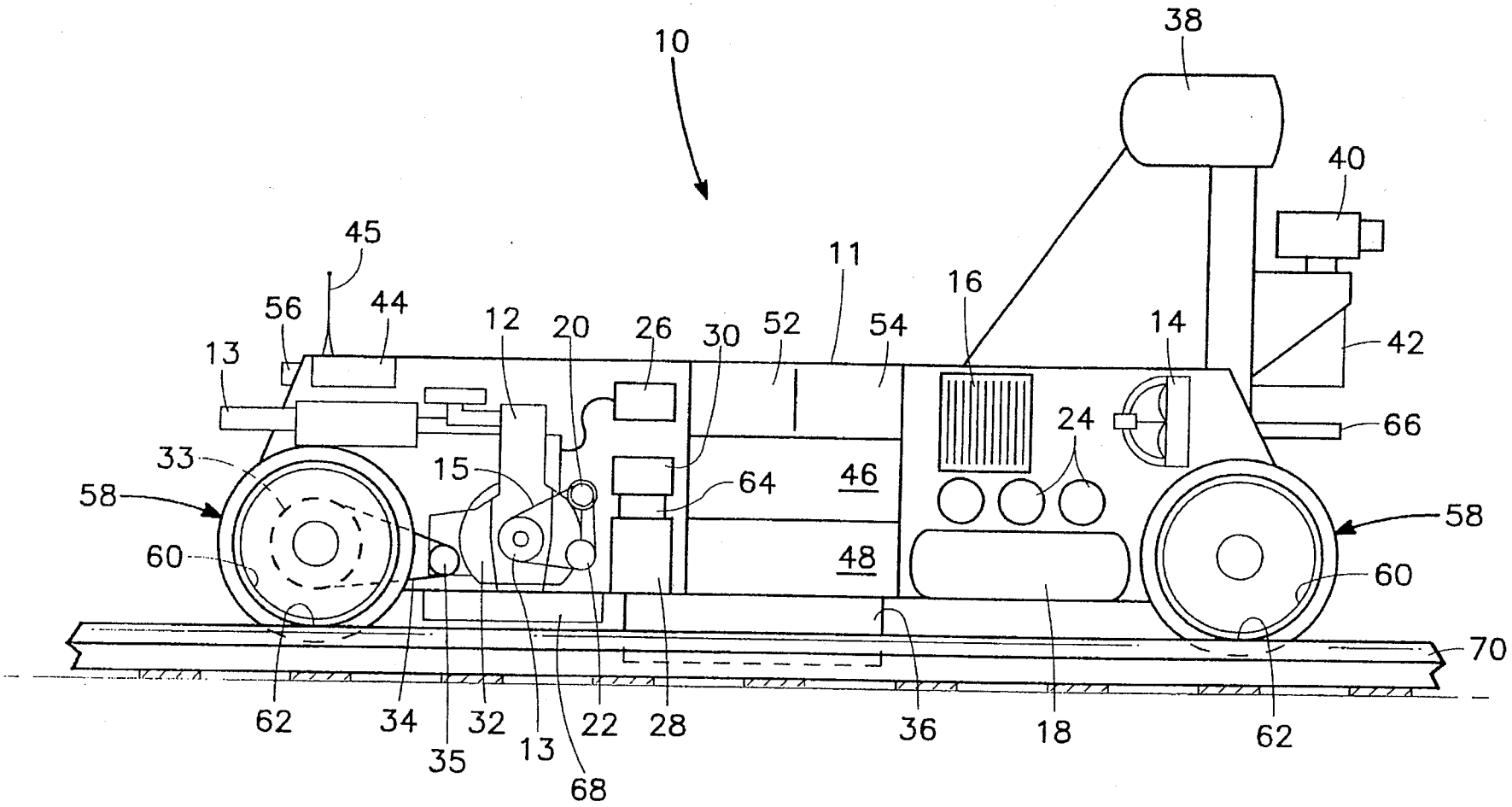
FIG. 1 is a detailed side view of a pilot vehicle of the present invention which is useful for monitoring hazardous conditions on a railroad track ahead of a train travelling at high speeds.

Referring first to FIG. 1, there is shown a pilot vehicle (designated generally by the reference numeral 10) which proceeds a rapidly moving train (not illustrated) along a set of rails or railroad track 70. Pilot vehicle 10 is self propelled and is remotely controlled by transmissions produced by the train. If pilot vehicle 10 encounters a potential hazard in railroad track 70 such as a stalled car, truck or bus at a railroad crossing, vehicle 10 may transmit information about the hazard back to the train. This permits the engineer driving the train to stop the train well before the train encounters the hazard.

In accordance with the present invention, pilot vehicle 10 is remotely controlled from the train. Mounted on board pilot vehicle 10 are sensing systems (to be discussed in greater detail shortly) for detecting and surveying conditions on railroad track 70 (such as a stalled vehicle at a crossing) as well as the condition of the track (as in a washed out bridge or a breakage in the rail of the track).

Pilot vehicle 10 includes an independent propulsion system that may be computer operated from pilot vehicle 10 or may be remotely controlled via a control signal transmitted from the train and received by pilot vehicle 10. The self-propelled propulsion system for pilot vehicle 10 comprises a diesel engine 12 mounted on a lower portion of the frame 11 of pilot vehicle 10 in proximity with the rear wheels of pilot vehicle 10. Diesel engine 12 includes a torque converter transmission 32 which has a drive pulley 35. There is attached to the left rear axle for left rear wheel 58 of pilot vehicle 10 a driven pulley 33. Connecting drive pulley 35 to driven pulley 33 is a drive belt 34. When transmission 32 rotates drive pulley 35 in a clockwise direction, drive pulley 35 drives driven pulley 33 in the clockwise direction causing pilot vehicle 10 to move in a forward direction (from left to right in FIG. 1). In a like manner, when transmission 32 rotates drive pulley 35 in a counter-clockwise direction, drive pulley 35 drives driven pulley 33 in the counter-clockwise direction causing pilot vehicle 10 to move in a rearward direction (from right to left in FIG. 1). It should be noted that the rear wheel drive system of pilot vehicle 10 may be a conventional differential drive system which permits the rear wheels to be driven at different speeds when pilot vehicle 10 is at a bend in railroad tracks 70.

Attached to diesel engine 12 is an exhaust 13 which expels exhaust fumes from diesel engine 12 into the atmosphere. Mounted on frame 11 near the front wheels 58 of pilot vehicle 10 is a fuel tank 18 which is used to store diesel fuel for the diesel engine 12 of pilot vehicle 10. Fuel tank 18 is connected to diesel engine 12 by a fuel pipe (not illustrated) and a fuel pump (not illustrated) which is used to pump diesel fuel from tank 18 to diesel engine 12. Pilot vehicle 10 also has a cooling system which includes a radiator and an exhaust fan 14 for cooling engine 12. The exhaust fan of radiator 14 moves cool air from the atmosphere across radiator 14 cooling radiator 14. The air for cooling radiator 14 is expelled into the atmosphere through a plurality of air vents 16 located in each side of the frame 11 of pilot vehicle 10.

The electrical power system for pilot vehicle 10 comprises a battery 28 and an alternator 20. Diesel engine 12 has a drive pulley 13 which is coupled to alternator 20 by a drive belt 15. Drive belt 15 also connects diesel engine 12 to an air compressor 22.

Air compressor 22 is connected to three air storage tanks 24 which store compressed air for use by an air activated braking system (not illustrated). The braking system for pilot vehicle 10 also includes a braking electronics module 30 which is coupled to computer 46 and a brake servo 64 coupled to braking electronics module 30. When computer 46 supplies digital braking control signals to braking electronics module 30, brake servo 64 activates the braking system for pilot vehicle 10 either bringing pilot vehicle 10 to a complete stop or significantly reducing the speed of pilot vehicle 10.

Pilot vehicle 10 also has a fluid or hydraulically activated rail clamp brake system 36 attached to the bottom of frame 11 of pilot vehicle 10. Rail clamp brake system 36 is used primarily in emergency situations (such as an obstacle in the path of the train) when it is required to bring pilot vehicle 10 to a complete stop in a short distance. Rail clamp brake system 10 is connected to air storage tanks 24 to receive compressed air from tanks 24. Rail clamp brake system 36 is also connected to computer 46 and receives digital rail clamp braking control signals from computer 46. The digital rail clamp braking control signals provided by computer 46 activate rail clamp brake system 36 which has a pair of engaging members (not shown) with the engaging members of rail clamp brake system 36 engaging both rails of railroad track 70 to bring pilot vehicle 10 to an emergency stop.

The Diesel engine's RPM (revolutions per minute) and thus the speed of pilot vehicle 10 are regulated by a throttle control 26 which is connected to the throttle of diesel engine 12. Throttle control 26 is also connected to on board computer 46 which provides digital throttle control signals to throttle control 26 to control the engine's RPM and the speed of pilot vehicle 10.

Computer 46 includes a distance keeping control module 54. Module 54 receives digital information and control signals from the train relating to its speed and present location relative to pilot vehicle 10. Module 54 uses this digital information to calculate a safe stopping distance D for the train. The distance D is the minimum safe stopping distance required by the train to come to a complete stop without causing damage to the train and injury to the personnel on board train as well as injury and damage to any obstacle in the path of the train such as a stalled vehicle at a railroad crossing. Factors utilized in calculating the minimum safe stopping distance D for the train include the present speed of the train, the grade of the track 70 upon which the train is presently travelling, the number of cars comprising the train and their weight, and the present weather conditions. When module 54 of computer 46 finishes its calculation for the present minimum safe stopping distance D for the train, computer 46 supplies throttle control signals to throttle control 26 adjusting the throttle of engine 12 which causes pilot vehicle 10 to accelerate, decelerate or maintain its present speed to keep the distance D relatively constant. The distance D also has an upper limit (one to two miles, for example) which is commensurate with railway control systems (such as block systems which monitor the movement, speed and spacing of multiple trains) so that pilot vehicle 10 is considered a part of the train. When the upper limit for distance D is exceeded then computer 46 will cause pilot vehicle 10 to decelerate until the distance between pilot vehicle 10 and the train less than this upper limit. The train may, for example, provide a control signal to the pilot vehicle 10 indicating to the pilot vehicle 10 that the train has stopped. The pilot vehicle 10 will also stop at the distance D ahead of the train.

Pilot vehicle 10 has a video camera 40 mounted on its front end. Video camera 40 allows the engineer in the train to observe the tracks 70 in front of pilot vehicle 10 via a video monitor (not shown) in the cab of the train. By monitoring a visual image of a section of track 70 well ahead of the train, the engineer on board the train can know what to expect and may take appropriate action to prevent potentially dangerous situations from occurring.

When, for example, pilot vehicle 10 is traveling at a speed of about 100 miles per hour and the engineer of the train while monitoring the video monitor in the cab of the train observes a bus or truck stalled at a railroad crossing, the engineer of the train can transmit an emergency stop signal to pilot vehicle 10. This emergency stop signal will activate the engaging members of rail clamp braking system 36 bringing pilot vehicle 10 to a complete stop in about eleven feet. Since pilot vehicle 10 weighs around five hundred pounds, a pilot vehicle 10 travelling at a speed of 100 miles per hour would subject the track 70 to a force of about 15,000 pounds during the emergency stop thus preventing serious damage to the rails of railroad track 70. In addition, the short stopping distance required to bring pilot vehicle 10 to an emergency stop would prevent serious damage to pilot vehicle 10, the vehicle stalled at the railroad crossing and also would prevent serious injury to the occupants of the vehicle.

It should be noted that video camera 40 may comprise a conventional fast scan or slow scan video camera which produces video information. Video camera 40 may include conventional servo motors to enable the engineer of the train to change the direction in which video camera 40 is aimed or the magnification of the camera lens of video camera 40.

There is also mounted on the front end of the frame 11 of pilot vehicle 10 an infrared camera 42 which allows the engineer of the train to monitor the tracks 70 ahead of pilot vehicle 10 in severe weather conditions or in total darkness. The infrared camera 42 is also adapted to detect humans or animals on or near tracks 70 by sensing their body temperature infrared signals.

The video signal from video camera 40 is supplied to a sensor data processing module 48 within computer 46 for processing thereby. The video signal is transmitted to the train utilizing a modulated radio frequency (RF) signal which the video monitor demodulates to provide a visual image/scene of the railroad track 70 in front pilot vehicle 10 for the engineer of the train. The infrared image/scene is transmitted from pilot vehicle 10 to the train in a similar manner allowing the engineer of the train to observe an infrared image of the railroad track 70 in front of pilot vehicle 10 in severe weather conditions or in total darkness or to detect animals or humans.

There is also mounted on the front of the frame 11 of pilot vehicle 10 an air sampling tube 66 which samples the atmosphere surrounding pilot vehicle 10. Air sampling tube 66 comprises a plurality of different conventional gas sensors each of which is sensing for the presence of a different hazardous or noxious gas above a predetermined safety level in the path of pilot vehicle 10. The gases which the gas sensors of air sampling tube 66 sense include carbon monoxide, methane, etc. which pilot vehicle 10 and the train may encounter while travelling through a tunnel or a wooded area where a fire is burning. The sensors of air sampling tube 66 are connected to the sensor data processing module 48 within computer 46 and provide electrical warning signals to module 48 for processing by module 48 whenever a noxious gas such as carbon monoxide exceeds the predetermined safety level for the particular noxious gas. Computer 46 generates a noxious gas warning message identifying the noxious gas which is transmitted via a radio frequency signal or the like to the engineer of the train indicating to the engineer of the train that a noxious gas is present in the atmosphere around pilot vehicle 10. The noxious gas warning signal also identifies the noxious gas for the engineer of the train.

Air sampling tube 66 may also include a moisture detector which comprises an electrode located within air sampling tube 66. The moisture detector within air sampling tube 66 monitors the moisture level in the atmosphere surrounding pilot vehicle 10 to indicate to the train whether pilot vehicle 10 is traveling through severe rainstorms or possibly a high water level which would be dangerous to the train. The moisture detector within sampling tube 66 also provides a warning signal to sensor data processing module 48 of computer 46 whenever the moisture level within the atmosphere exceeds a predetermined safety level. The moisture detector within sampling tube 66 may operate using the difference in electrical conductivity between air and water, or it may comprise any other conventional moisture detector.

Each of the four wheels 58 of pilot vehicle 10 is electrically conductive at its outer flange 62 which is in contact with the rail of railroad track 70. Outer flange 62 is electrically insulated from the remainder of the wheel and pilot vehicle 10 by an insulated ring 60 located adjacent the outer flange 62 of each wheel 58. These electrically insulated wheels allow pilot vehicle 10 to activate railroad block signal control systems, crossing gates and the like.

In addition, the electrically conductive outer flange 62 of each wheel 58 of pilot vehicle 10 include slip rings (not shown) which allow the electrically conductive outer flange 62 of each wheel 58 to be connected to the sensor data processing module 48 of computer 46. The wheels 58 of pilot vehicle 10 sense breaks in the rail of railroad track 70 which effect the intensity level of currents passing through the rails of track 70 from the front wheels 58 to the rear wheels 58 of pilot vehicle 10. The current from the rails also passes through the wheels 58 to the sensor data processing module 48 of computer 46. When a partial or complete break in either rail of track 70 occurs the intensity of the current flow through the wheels 58 of pilot vehicle 10 will change. The sensor data processing module 48 of computer 46 senses this change in current flow providing a digital signal to computer 46 which then generates a warning message indicating track breakage which is transmitted to the engineer of the train.

The communications system for pilot vehicle 10 includes a transmitter/receiver 44 which is placed on board pilot vehicle 10. The transmitter and the receiver of transmitter/receiver 44 are connected via a transmit/receive switch (not shown) to an antenna 45 mounted on pilot vehicle 10 near the rear end of pilot vehicle 10. The transmitter and the receiver of transmitter/receiver 44 are tuned to the same frequency as the transmitter and the receiver on board the train. In this way, control information generated on board the train may be transmitted via the transmitter of the train to receiver of transmitter/receiver 44 and thereafter supplied to circuitry including computer 46 on board pilot vehicle 10. Likewise, information sensed by pilot vehicle 10 may be transmitted to the train via the transmitter of transmitter/receiver 44 to the receiver on board the train and thereafter supplied to the monitoring systems on board the train to apprise the engineer of rail conditions ahead of the train.

The transmitter 44 of transmitter/receiver 44 transmits microwave signals to the receiver on board the train. The microwave signals may be radio frequency signals or other signals in the microwave signal frequency range. The microwave signals are generally transmitted through the air via antenna 45. The microwave signals transmitted by the transmitter of transmitter/receiver 44 may be modulated by a signal modulator 52 which is responsive to the signals produced by various sensors on board pilot vehicle 10. Signal modulator 52 may modulate these microwave signals by any known modulation method (such as frequency modulation, amplitude modulation, pulse code modulation, pulse width modulation, etc.). The microwave signals generated by the transmitter of transmitter/receiver 44 may also be modulated by the video signal produced by television camera 40. The receiver of transmitter/receiver 44 is connected to a signal demodulator which is an electrical component of signal modulator 52 and which demodulates the signals impressed upon the microwave signals transmitted by the train to pilot vehicle 10.

It should be noted that VHF (very high frequency) signals and RF (radio frequency) signals could also be used to transmit information from pilot vehicle 10 to the train as well as transmitting information from the train to pilot vehicle 10. A system which may be adapted for use with pilot vehicle 10 is the AN/URY-3 relay/responder/reporter which is a multilateration tracking system for extended area tracking. Communications between relay/responder/reporter units is a radio frequency transmission of spread spectrum pulses centered at 141 MHz, utilizing antennas similar to antenna 45 of pilot vehicle 10.

As is well known, plural signals may be multiplexed onto the same transmitted carrier signal. The transmitter of transmitter/receiver 44 may produce microwaves, infrared radiation or ultrasonic radiation. A receiver on board the train receives the transmitted signal and demultiplexes the various signals impressed upon it. Each of the demultiplexed signals may be routed to a respective indicator on board the train.

Those skilled in the art can readily devise other methods for transmitting information between pilot vehicle 10 and the train. For example, conventional electrical signals conducted by the rails or by overhanging cables could be used to convey information. Acoustic signals transmitted over the rails might be used to transmit information between the train and pilot vehicle 10. The present invention is by no means limited to any one such method for transmitting information between the train and pilot vehicle 10.

Mounted on frame 11 at the rear of pilot vehicle is a rear warning light 56 which indicates to the train or another railroad vehicle approaching pilot vehicle 10 from its rear that pilot vehicle 10 is within sight of the oncoming vehicle. There is also attached to the front of frame 11 a headlight 38 which warns objects in the path of pilot vehicle 10 that pilot vehicle 10 is approaching. In addition, pilot vehicle 10 may be equipped with a horn, whistle or the like which functions as a warning device when pilot vehicle 10 is approaching a station, a railroad crossing, a train temporarily stopped at a siding or other objects which may be in the path of pilot vehicle 10.

Pilot vehicle 10 has a magnetic signature sensing system 68 which is mounted on the underside of the frame 11 of pilot vehicle 10 so as to be in close proximity with each rail of railroad track 70. Magnetic signature sensing system 68 senses the strength/intensity of the magnetic field generated by low level currents passing through the rails of track 70. When there is break in one or both of the rails of railroad track 70, current will cease flowing through the broken rails. Magnetic signature sensing system 68 will then detect the resulting decrease in the strength of the magnetic field should only one rail break or the lack of a magnetic field should both rails break. Magnetic signature sensing system 68 is connected to the sensor data processing module 48 of computer 46 to receive an electrical signal from magnetic signature sensing system 68 which indicates the strength of the magnetic field surrounding the rails of railroad track 70. When sensor data processing module 48 of computer 46 detects a significant decrease in the voltage level of the electrical signal from system 68 indicating a significant decrease in the magnetic field strength, computer 46 generates a warning message which is transmitted via a radio frequency signal or the like to the engineer of the train indicating a break in one or both rails of the track ahead of the train. If, for example, the voltage level of the electrical signal from system 68 is zero volts this indicates that both rails of railroad track 70 are broken.

Magnetic signature sensing system 68 may comprise an AC (alternating current) magnetic bridge coil which generates a low energy alternating magnetic field that couples with an adjacent section of rail of track 70. An alternating current bridge operating at a pre-selected frequency may be chosen for measurement sensitivity. An inductive reactance measured by the sensor coil of the bridge will unbalance the bridge circuit to a magnitude which is unique to an adjacent section of the rail. This unbalanced signal is compared with a prior recorded unbalanced signature for the section of rail being sampled which is stored in computer 46. The location of the section of track being measured may be determined by the number of revolutions of wheels 58. Computer 46 uses the count of the number of revolutions of wheels 58 for a comparison with position information stored in computer 46 to determine the precise location of the section of track being sampled by magnetic signature sensing system 68.

A wave guide mounted on pilot vehicle 10 may be used to perform a structural analysis of the rail of track 70 to determine if there is damage to the rail of track 70. The standing wave ratio of the waveguide (which may be an x-band waveguide) is compared with a prior standing wave ratio (stored in computer 46) for the particular section of track being measured. Significant differences in the standing wave ratios indicate a structural change in the rails of track 70 and thus possible damage to the rails of track 70.

Figure 2A:
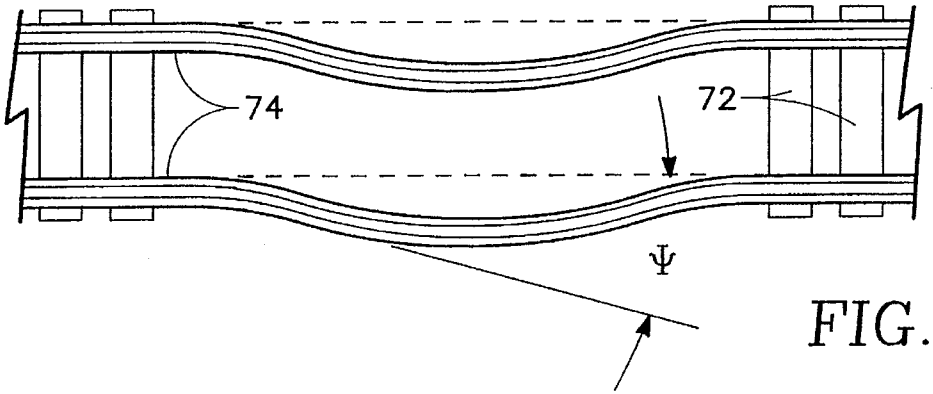
FIG. 2 illustrates various attitude changes to track caused by damage to the track's road bed.
Figure 2B:
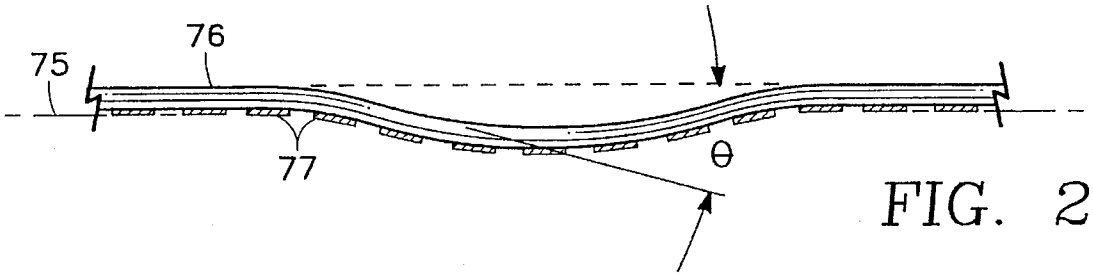
Figure 2C:
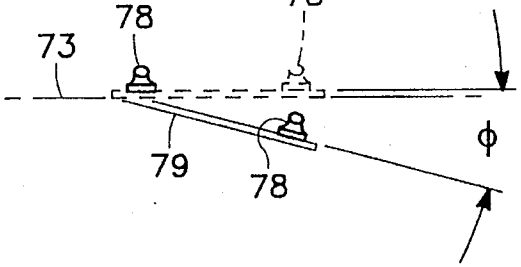

Referring to FIGS. 1 and 2 there is shown various types of damage which can occur to railroad track upon which pilot vehicle 10 is riding. In FIG. 2A a section of railroad track 74 has undergone an angular orientation change because of loss of roadbed and ties 72 with the angle of damage signature for FIG. 2A being defined by the angle psi ($\psi$). In FIG. 2B there is shown a depression in rails 76 from a horizontal plane 75 because of a loss of roadbed and earth underneath the ties 77 of the railroad track. The angle of damage signature for FIG. 2B is defined by the angle theta ($\theta$). In FIG. 2C the railroad track and ties 79 are angled from the horizontal plane 73 which is the original position of track 78 (illustrated in phantom). This change in angular orientation may occur because of a partial loss of earth underneath the track 78. The angle of damage signature for FIG. 2C is defined by the angle phi ($\phi$). The pre-damage to post damage angular changes in the railroad tracks of FIGS. 2A, 2B and 2C can be as small as minutes or seconds of an arc. However, these angular changes are indicative of the damage that threatens the integrity of the railroad tracks upon which pilot vehicle 10 is riding.

It should be noted that the angle of change for FIGS. 2A, 2B and 2C may also be defined by the terms yaw ($\psi$), pitch ($\theta$) and roll ($\phi$).

Figure 3:
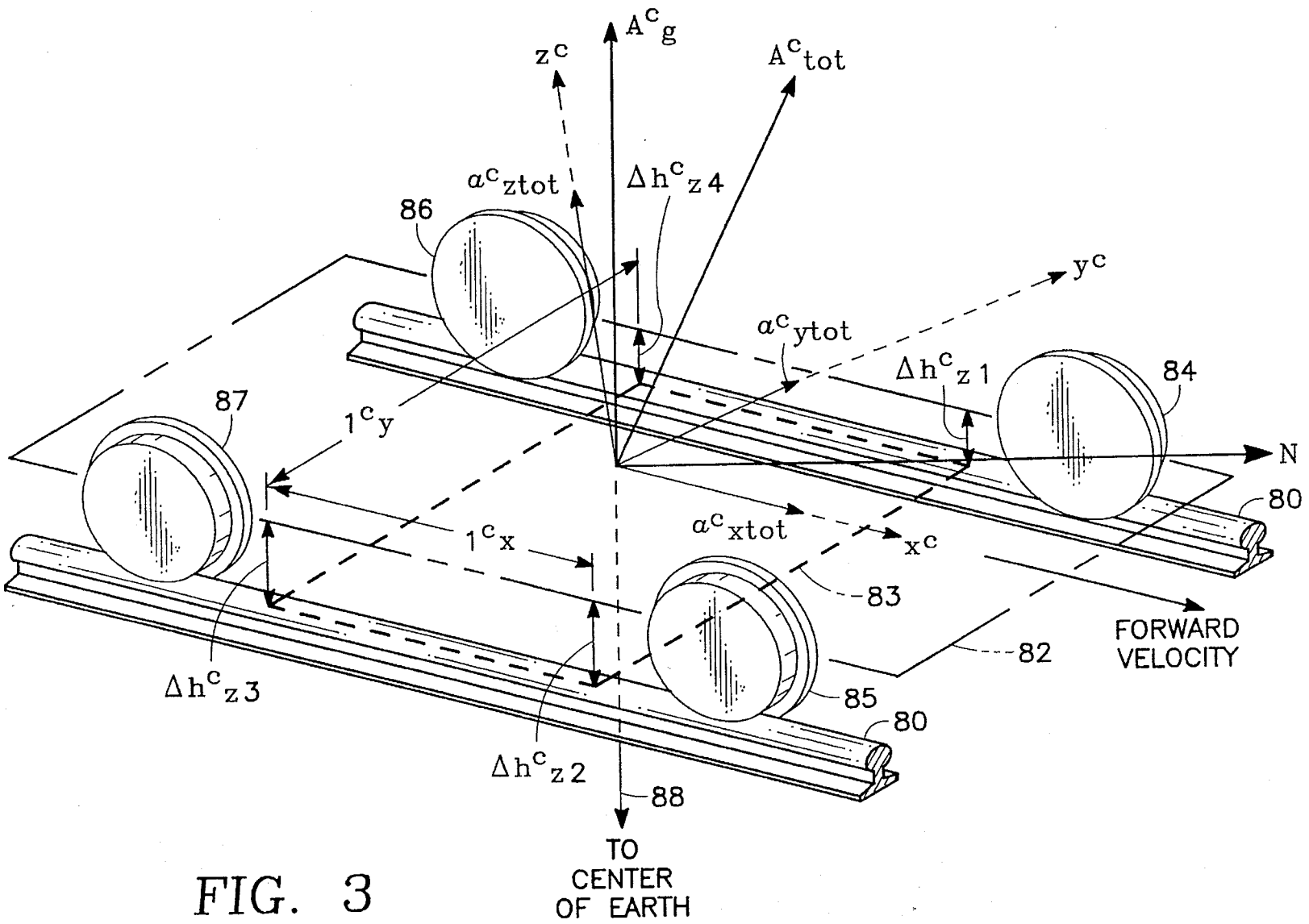
FIG. 3 is a schematic view illustrating an idealized rail top reference tilt grid system adapted for use with the pilot vehicle of FIG. 1.

Referring now to FIGS. 1 and 3 there is shown a schematic view illustrating an idealized rail top reference tilt grid 83 adapted for use with the pilot vehicle 10. Rail top reference tilt grid 83 is used to measure the tilt of the plane of the rail tops (illustrated by the dashed line rectangle FIG. 3) under pilot vehicle 10 relative to a local vertical axis. Rail top reference tilt grid 83 also measures the azimuth heading of rails 80 in a predetermined direction. This information, which is in a 3×3 direction cosine matrix format, is compared with information previously recorded for the same section of railroad track to locate changes in track orientation and thereby be able to determine if there is damage to the track.

Referring to FIGS. 1, 3, 7, 8A and 9, rail top reference tilt grid 83 for pilot vehicle 10 includes a three axis accelerometer 208 (FIG. 9) which responds to the total acceleration of the pilot vehicle's coordinate reference system. The total acceleration vector $A^c_{tot}$ comprises a gravity reaction component $A^c_g$, a car rail constrained kinematic motion component $A^c_{mn}$ and a Coriolis component due to motion across the face of a rotating Earth.

Three axis accelerometer 208 has axes parallel to the major axes of pilot vehicle 10. The major axes are (1) the x axis which is in the plane of the reference platform 82 (FIG. 3) of pilot vehicle 10 and parallel to its longitudinal axis; (2) the y axis which is in the plane of the reference platform 82 (FIG. 3) of pilot vehicle 10 and parallel to its lateral axis and (3) the z axis which is normal to the plane of the reference platform 82 (FIG. 3) of pilot vehicle 10.

For the following discussion the nomenclature utilized is as follows: (1) the superscript of a vector or component identifies the coordinate system (e.g. e, earth center; c pilot vehicle) and (2) the subscript of a vector or component identifies the axis (x, y, z) and the type of acceleration (g, gravity; mn, motion caused; cor, Coriolis; tot, total). The angles of rotation about the pilot vehicle's major reference axis (x, y, z) are identified as phi, theta and psi respectively. Appendix A is a listing which defines the symbols used in the equations set forth in the following discussion.

The acceleration vector $A^c_g$, which represents a reaction to the attraction of earth's gravity, is opposite in direction to the vector 88 which points to the center of the earth. This is referred to as the D'Alembert acceleration reaction caused by rails 80 supporting pilot vehicle 10 against the pull of gravity. The three axis accelerometer 208 (FIG. 9) register components of gravity reaction acceleration (32.174 ft/sec$^2$ normal to a local horizontal) along the pilot vehicle's reference axis $x^c$, $y^c$ and $z^c$. It should be noted that the accelerometers of three axis accelerometer 208 are positioned so that their response axis are parallel to each of the pilot vehicle's reference axis $x^c$, $y^c$ and $z^c$.

Figures 8A, 8B, 8C:
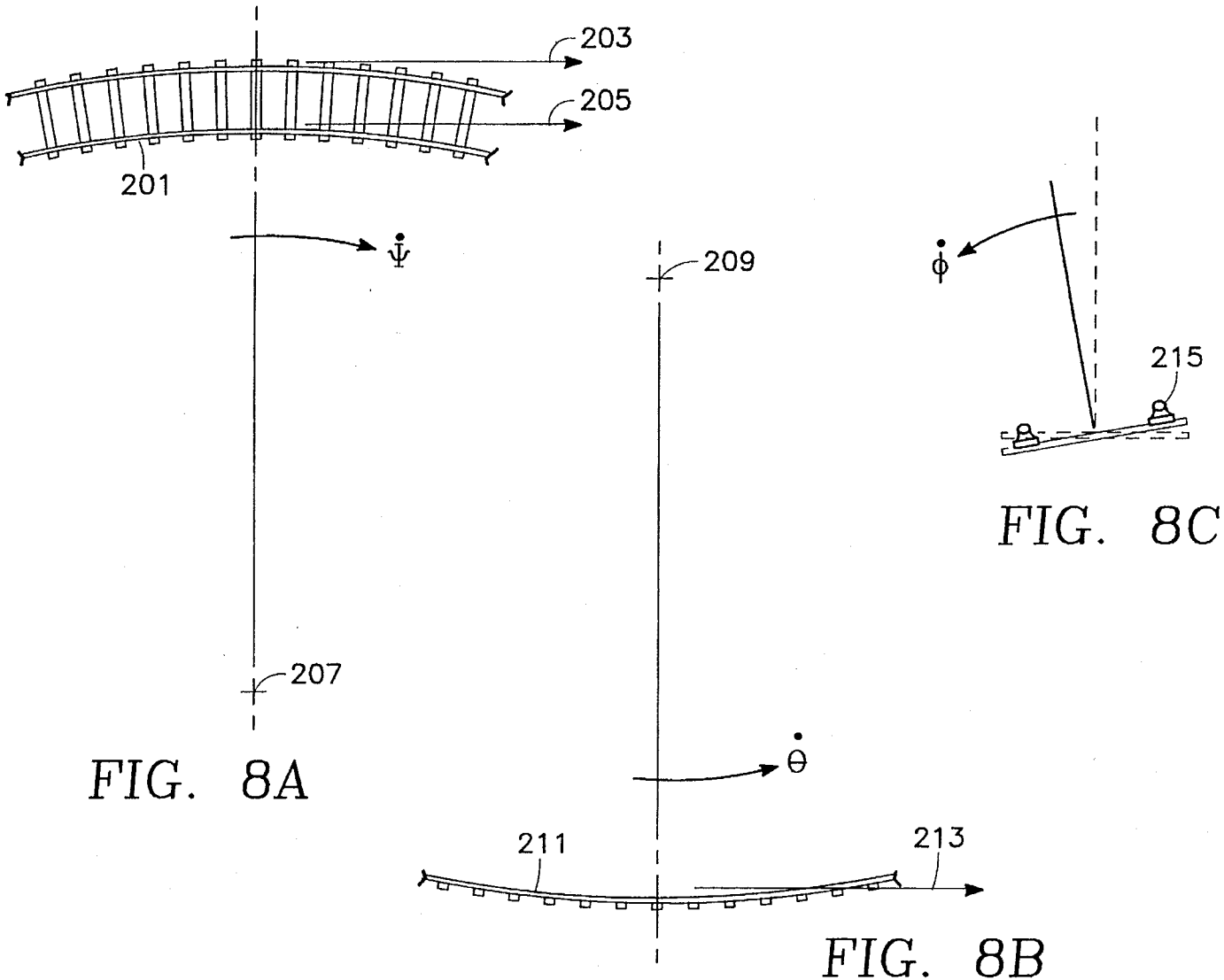
FIGS. 8A–8C illustrate various radius of turn of the railroad tracks upon which the pilot vehicle of FIG. 1 rides.

The radius of turn of the tracks $R_t$ in the plane of the top of the rails (201 in FIG. 8A) is given by the following equation:

$$R_t = \left(\frac{d_g}{2}\right)\frac{(V1+V2)}{(V1-V2)} \tag{1}$$

where $d_g$ is the track gage provided by track gage module 202 (FIG. 9) or rail separation and V1 and V2 are the outer and inner data wheels 110 (FIGS. 5 and 9) differential velocities 203 and 205 while the pilot vehicle traverses the turn illustrated in FIG. 8A.

The acceleration of pilot vehicle 10 along its lateral or y axis is given by using equation (1) and the yaw rate $\dot{\psi}$ of the vehicle 10 as determined by the differential velocities of the two data wheels 110 (FIG. 5) and the track gage for railroad track 201.

$$\psi = \frac{V1 - V2}{d_g} \tag{2}$$

$$a^{c'}_{ymn} = \frac{V1^2 - V2^2}{2d_g} \tag{3}$$

Equation three is only a component of the acceleration of pilot vehicle 10 caused by rail-constrained kinematics. The full acceleration of the pilot vehicle 10 along its lateral or y axis due to its rail constrained motion includes a Coriolis acceleration component added to the equation resulting in equation four:

$$a^c_{ymn} = \frac{V1^2 - V2^2}{2d_g} + 2\omega_e V_x^c \sin(\Psi_L) \tag{4}$$

The acceleration of pilot vehicle 10 along its vertical axis caused by rail constrained motion is determined from the following equation:

$$a^c_{zmn} = \dot{\theta}^c V^c_x - 2\omega_e V^c_x \sin(\theta_N) \cos(\psi_L) \tag{5}$$

where $\dot{\theta}$ (FIG. 8B) is the pitch rate provided by a vertical rate gyro 206 within the inertial platform 114 on pilot vehicle 10.

The acceleration of pilot vehicle 10 along its fore and aft or x axis caused by rail constrained motion is determined from the following equation:

$$a^c_{xmn} = \frac{dV_x^c}{dt} \tag{6}$$

Figure 9:
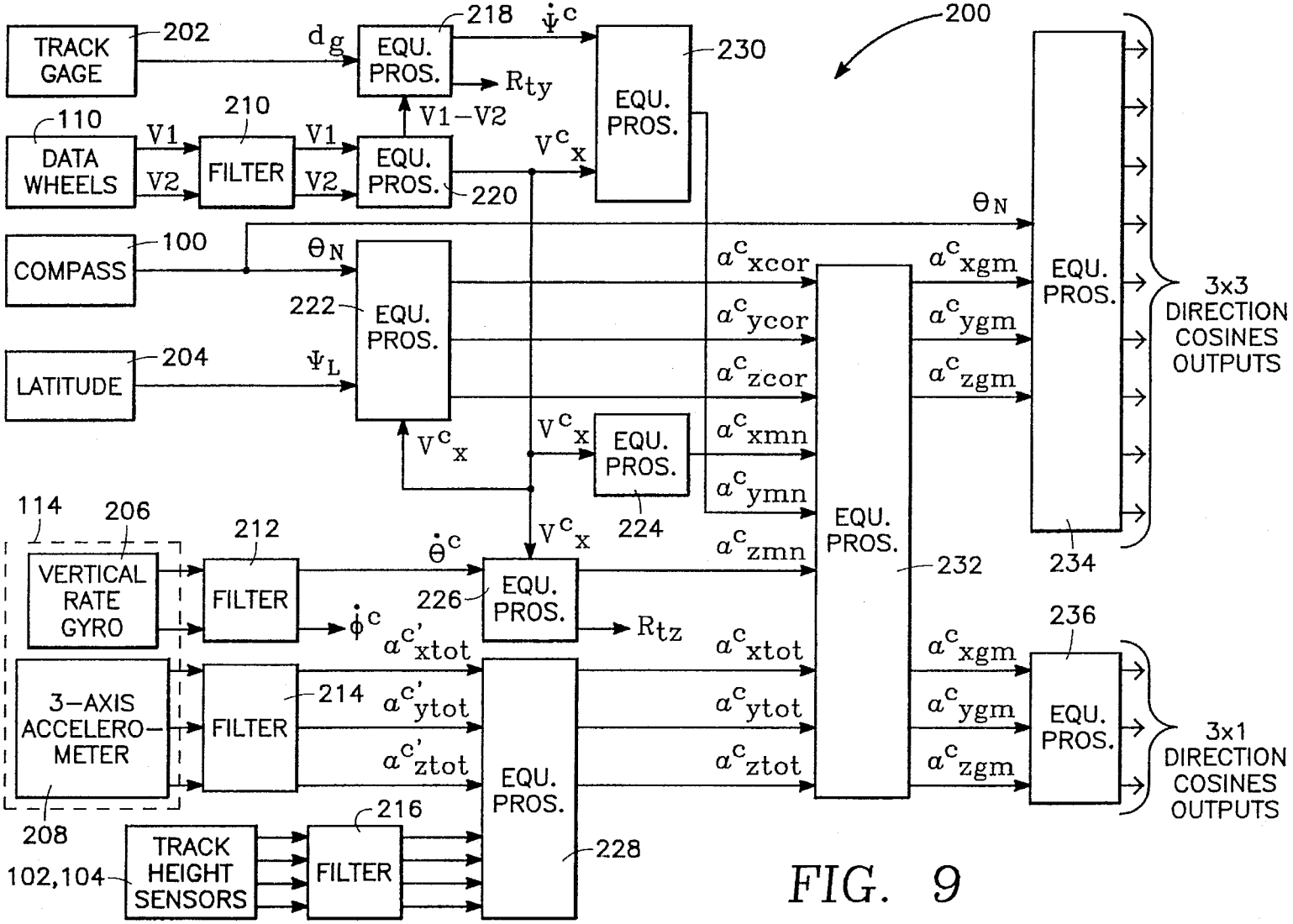
FIG. 9 is a block diagram which illustrates a processor for processing data received by the pilot vehicle's rail top reference tilt grid system.

As shown in FIG. 9 equation processor 224 provides $a^c_{xmn}$ after filtering of the pilot vehicle's forward velocity by filter 210. For level tracks $a^c_{xmn}$ equals $a^c_{xtot}$.

The components of the rail constrained acceleration vector $A^c_{mn}$ for pilot vehicle 10 are determined in accordance with the following equation:

$$A_{c_{mn}} = a^c_{xmn} 1^c_x + a^c_{ymn} 1^c_y + a^c_{zmn} 1^c_z \tag{7}$$

where $1^c_x$, $1^c_y$ and $1^c_z$ are unit vectors respectively along the pilot vehicle's x, y and z axis.

The Coriolis acceleration is derived from tracking a moving object in a rotating coordinate system, which for the present invention is earth. The Coriolis acceleration is a vector in an earth centered coordinate system and is given by the following equation:

$$\text{Coriolis Acceleration} = 2\omega_e \times \dot{\rho} \tag{8}$$

where $\omega_e$ is the rotation of the earth about its polar axis (0.0000727 radians per second) and $\dot{\rho}$ is the pilot vehicle's velocity vector in the earth centered coordinate system.

Pilot vehicle 10 is constrained relative to the surface of the earth. Since the Coriolis acceleration is minimal for normal train speeds (e.g. 30–80 mph) and train tracks are generally level, the approximate pilot vehicle axis Coriolis accelerations are given by the following equations:

$$a^c_{xcor} = 0 \tag{9}$$

$$a^c_{ycor} = 2\omega_e V^c_x \sin(\psi_L) \tag{10}$$

$$a^c_{zcor} = -2\omega_e V^c_x \sin(\theta_N) \cos(\psi_L) \tag{11}$$

where $\sin(\psi_L)$ is the sine of the degree latitude location of the railroad track and $\cos(\theta_N)$ is the cosine of the angle of the track heading relative to true north.

Since the Earth's rotation is 0.00417 degrees per second, a pilot vehicle 10 moving at 200 ft/sec (136 mph) on a heading 30 degrees east of true north and located at 30 degrees north latitude senses a 0.0145 ft/sec$_2$ acceleration along the pilot vehicle's Y axis and 0.0126 ft/sec$_2$ acceleration down along the pilot vehicle's negative Z axis. While these magnitudes are minimal, the magnitudes would register on the pilot vehicle's three axis accelerometers 208 and must be accounted for to compute the exact rail top reference tilt grid attitude relative to the local horizontal. Data from magnetic compass 100 and input data for the latitude location of the track being analyzed, which is provided by latitude location apparatus 204, would allow calculation of the Coriolis accelerations being sensed by the pilot vehicle's accelerometer 208. Latitude location apparatus, may be, for example a global positioning system.

The total acceleration vector, $A^c_{tot}$, sensed by three axis accelerometer 208 for pilot vehicle 10 consist of the gravity caused and the rail constrained motion caused acceleration components expressed by the following equation:

$$A^c_{tot} = A^c_g + A^c_{mn} + A^c_{cor} \tag{12}$$

Solving for $A^c_g$, which is the acceleration vector in the pilot vehicle's coordinate system opposite of gravity) provides the tilt in pitch and roll of the rail top reference tilt plane relative to the local gravity vertical.

$$A^c_g = A^c_{tot} - A^c_{mn} - A^c_{cor} \tag{13}$$

It should be noted that $A^c_{mn}$ is provided by equation seven and $A^c_{cor}$ is provided by equations seven, eight and nine.

The components of the gravity acceleration vector $A^c_g$ are determined in accordance with the following expression:

$$A^c = a^c_{xg} 1^c_x + a^c_{yg} 1^c_y + a^c_{zg} 1^c_z \tag{14}$$

where $a^c_{xg}$ is the acceleration due to gravity along the pilot vehicle's x axis, $a^c_{yg}$ is the acceleration due to gravity along the pilot vehicle's y axis and $a^c_{zg}$ is the acceleration due to gravity along the pilot vehicle's z axis.

The absolute value for the vector $A^c_g$ is determined from the following expression:

$$Abs(A_g^c) = \sqrt{a^{c2}_{xg} + a^{c2}_{yg} = a^{c2}_{xg}} \tag{15}$$

The three direction cosines between the local vertical and the pilot vehicle's reference plane (illustrated in FIG. 3) are provided as dot products of unit vectors as follows:

$$1_z^g \cdot 1_x^c = \frac{a^c_{xg}}{Abs(A_g^c)} \tag{16}$$

$$1_z^g \cdot 1_y^c = \frac{a^c_{yg}}{Abs(A_g^c)} \tag{17}$$

$$1_z^g \cdot 1_z^c = \frac{a^c_{zg}}{Abs(A_g^c)} \tag{18}$$

The direction cosines in equations sixteen, seventeen and eighteen are an expression of the tilt of the rail top grid lying on the section of track being measured by grid 83 of pilot vehicle 10. The direction cosines are then compared with corresponding direction cosine data stored on a CD rom or memory within computer 46 for the particular section of track being monitored. Differences would indicate changes in the track or roadbed indicative of the failure types illustrated in FIG. 2.

It is desirable to have additional information about the section of track on which the pilot vehicle's rail top reference tilt grid 83 rides. In order to convert 3-axis information from the pilot vehicle 10 to the section of track which it currently occupies, it is necessary to develop a 3×3 matrix of direction cosines for the pilot vehicle's reference plane axes relative to the earth horizontal reference axes, as seen in FIG. 3.

Figure 7:
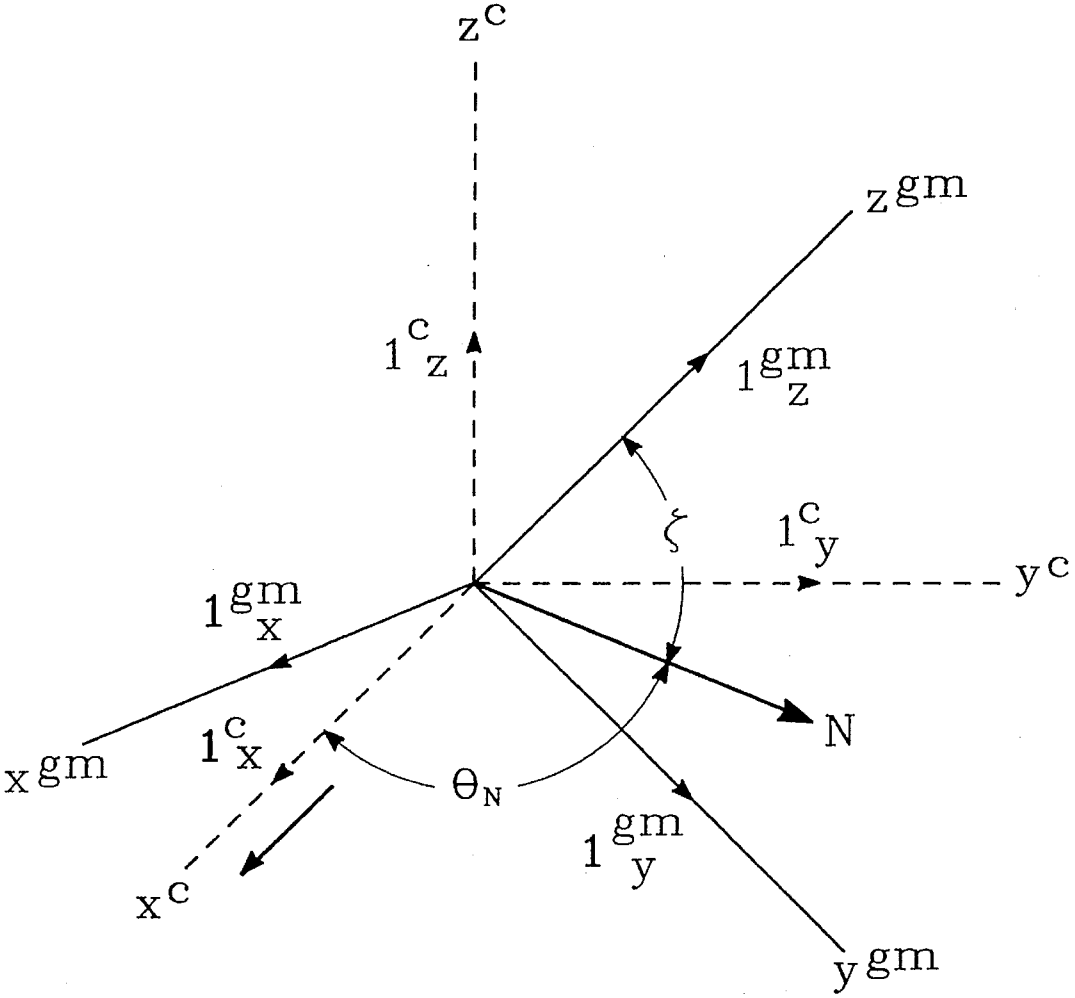
FIG. 7 illustrates the coordinate system axes and vectors for the rail top reference tilt grid system which is used on the pilot vehicle of FIG. 5.

The magnetic heading of pilot vehicle 10 is used to form an interim gravity magnetic north, or G M, coordinate reference system which is illustrated in FIG. 7. The gravity magnetic north coordinate system of FIG. 7 lies in the local horizontal reference plane perpendicular to the gravity vector. The magnetic direction is a unit vector N lying in the x y reference plane of pilot vehicle 10 with the following $x^c$ and $y^c$ components:

$$N=\cos(\theta_N)1^c{}_x+\sin(\theta_N)1^c{}_y \tag{19}$$

From equation nineteen and the dot product of the x-axis of the gravity magnetic north system of FIG. 7 with respect to each of the pilot vehicle's axes, the following direction cosines result:

$$1_x^{gm}\cdot 1_x{}^c=\frac{\sin(\theta_N)a_{zg}^c}{\sin(\zeta)Abs(A_g{}^c)} \tag{20}$$

$$1_x^{gm}\cdot 1_y{}^c=\frac{-\cos(\theta N)a_{zg}^c}{\sin(\zeta)Abs(A_g{}^c)} \tag{21}$$

$$1_x^{gm}\cdot 1_z{}^c=\frac{\cos(\theta_N)a_{yg}^c-\sin(\theta N)a_{xg}^c}{\sin(\zeta)Abs(A_g{}^c)} \tag{22}$$

where $\zeta$ is the angle between the compass north N and the gravity vertical unit vector $1^{gm}{}_z$ as shown in FIG. 7.

Sin ($\zeta$) is determined in accordance with the following expression:

$$\sin(\zeta)=\cos(\theta_N)1^c{}_x\times 1^{gm}{}_z+\sin(\theta_N)1^c{}_y\times 1^{gm}{}_z \tag{23}$$

The unit vector $1^g{}_z$ in equations sixteen, seventeen and eighteen is the same as the unit vector $1^{gm}{}_z$. Equations sixteen, seventeen, twenty, twenty one and twenty two provide six of the nine direction cosines. When the nine direction cosines are arranged in a 3×3 matrix the following results:

$$\begin{vmatrix} 1_x^{gm}\cdot 1_x{}^c & 1_x^{gm}\cdot 1_y{}^c & 1^{gmX}\cdot 1_z{}^c \\ 1_y^{gm}\cdot 1_x{}^c & 1_y^{gm}\cdot 1_y{}^c & 1_y^{gm}\cdot 1_z^{gm} \\ 1_z^{gm}\cdot 1_x{}^c & 1_z^{gm}\cdot 1_y{}^c & 1_z^{gm}\cdot 1_z{}^c \end{vmatrix}=\text{dir cos} \tag{24}$$

For example, $1^{gm}{}_x$ and $1^c{}_x$ are unit direction vectors in the earth and car coordinate systems, respectively. As is best seen in FIG. 7, the local earth is now represented by the gravity magnetic north coordinate system, of which the $x^{gm}$ and $y^{gm}$ plane is the local horizontal.

The sum of the squares of elements in a row=1 and the sum of the elements in a column=1 for an orthogonal direction cosine matrix. To derive the middle row of direction cosines for the matrix the known top row and bottom row elements are utilized. This, in turn, results in the following expressions for the middle row of the matrix:

$$1_y^{gm}\cdot 1_x{}^c=\sqrt{1-(1_x^{gm}\cdot 1_x{}^c)^2-(1_z^{gm}\cdot 1_x{}^c)^2} \tag{25}$$

$$1_y^{gm}\cdot 1_y{}^c=\sqrt{1-(1_x^{gm}\cdot 1_y{}^c)^2-(1_z^{gm}\cdot 1_y{}^c)^2} \tag{26}$$

$$1_y^{gm}\cdot 1_z{}^c=\sqrt{1-(1_x^{gm}\cdot 1_z{}^c)^2-(1_z^{gm}\cdot 1_z{}^c)^2} \tag{27}$$

The direction cosine matrix (24) permits information gathered by pilot vehicle 10 to be transformed into vector data associated with the particular section of track that grid 83 (FIG. 3) is resting on.

Referring now to FIG. 9, there is shown a flow system 200 required to compute the orientation of the rail top reference tilt grid 83.

Figure 4:
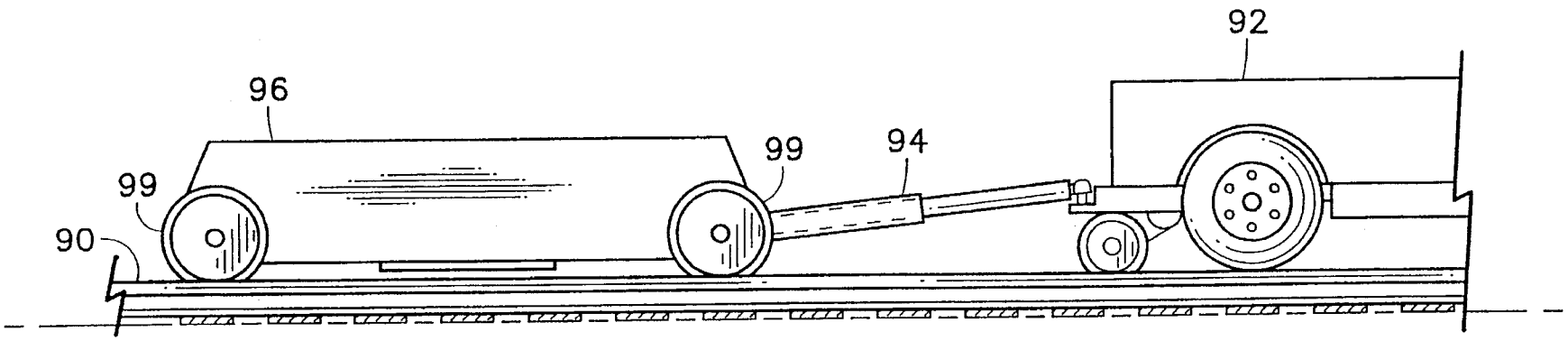
FIG. 4 is a side view of alternative embodiment of the pilot vehicle of FIG. 1 which is not self propelled.

Referring to FIG. 4, there is shown an embodiment of the pilot vehicle of the present invention which is towed by a powered vehicle 92 riding on railroad tracks 92. A shock absorbing tow bar 94 is used to tow pilot vehicle 96 along railroad tracks 90 with the wheels 99 of vehicle 96 riding on railroad tracks 90.

Figure 5:
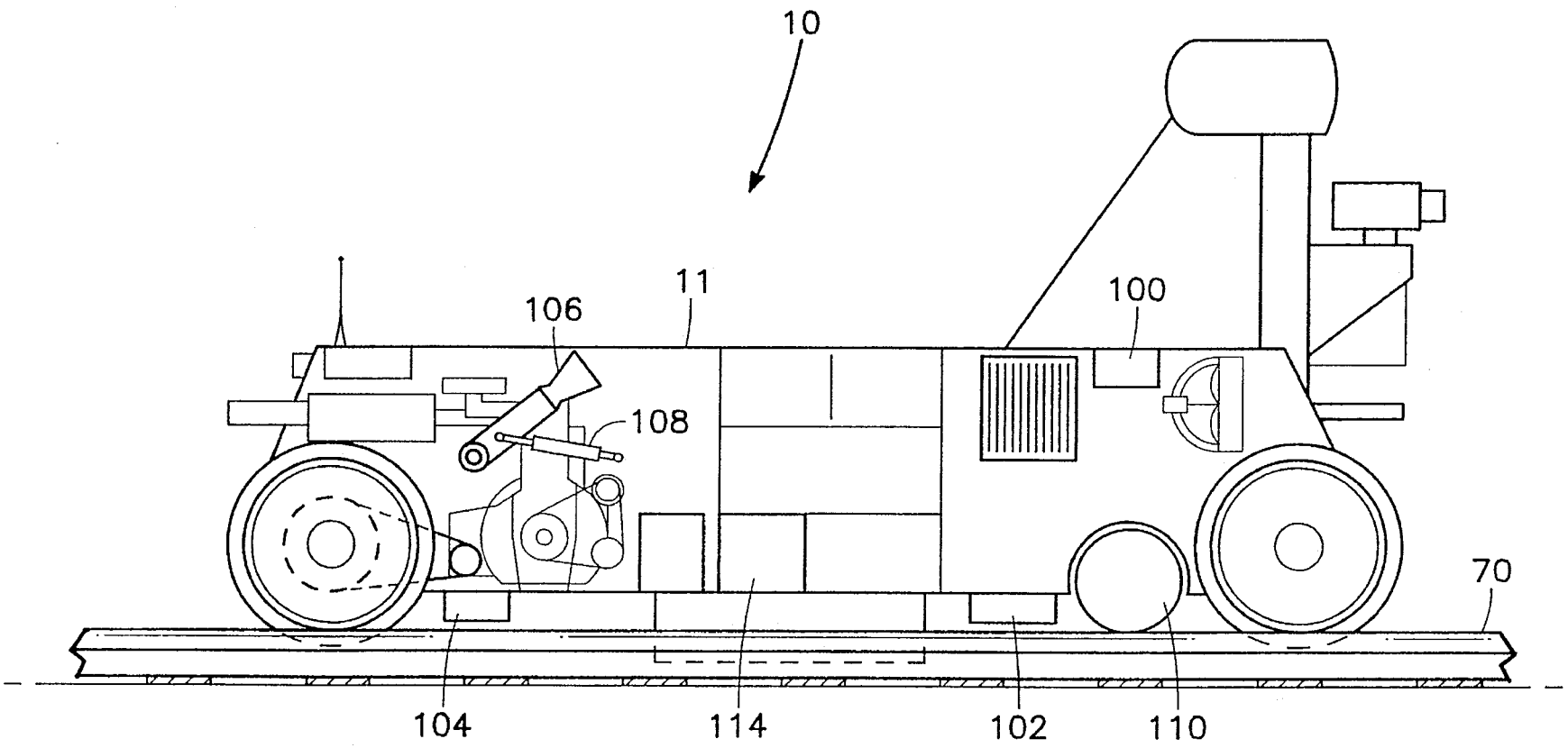
FIG. 5 illustrates the placement of the reaction jet stopping system on the pilot vehicle of FIG. 1 and the placement of the components of the rail top reference tilt grid system on the pilot vehicle of FIG. 1.

Referring to FIGS. 1, 3, 5 and 6A–6D, when the frame 11 of pilot vehicle 10 is sprung relative to the wheels 58 of pilot vehicle 10, pilot vehicle 10 includes four rail height sensors which are affixed to frame 11 adjacent each corner of frame 11. Two of the four rail height sensors 102 and 104 for the left side of vehicle 10 are depicted in FIG. 5.

The height of frame 11 above the top of rail 70 can then be measured by rail height sensors 102 and 104 which are located at each corner of frame 11 at a position which approximates the rail top reference tilt grid 83 of FIG. 3 for pilot vehicle 10. These measurements are provided to the pilot vehicle's on board computer 46 which analysis the measurements to determine the pitch and roll angles between the pilot vehicle reference plane 82 and the rail top reference tilt grid 83.

Figure 6B:
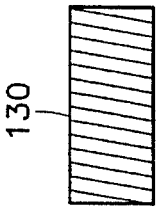
FIGS. 6A–6D illustrate various rail height indicator systems adapted for use with the pilot vehicle of FIG. 1.
Figure 6A:
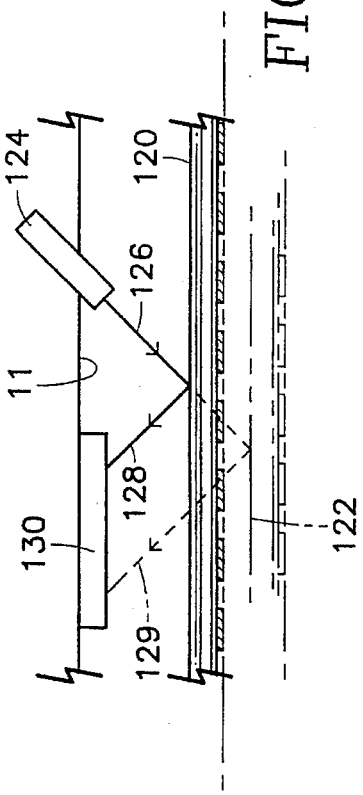
Figure 6C:
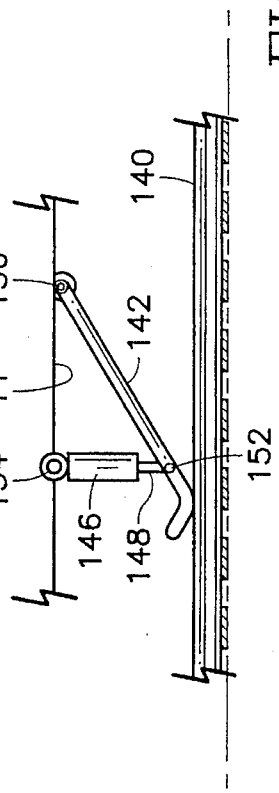

The rail height sensor of FIG. 6A includes a laser 124 mounted on the underside of frame 11 of pilot vehicle 10. Laser 124 generates a pulsed beam of laser energy 126 which is directed toward the top of rail 120. A portion of the laser energy 128 is reflected from the top of rail 120 to a sensing element 139 which is attached to the underside of frame 11 of pilot vehicle 10. By comparing the measurements of laser energy from each sensing element 139 of the four rail height sensor of pilot vehicle 10 computer 46 can determine whether car reference plane 82 of pilot vehicle 10 is being maintained parallel to the rail top reference tilt grid system 83 for pilot vehicle 10.

The rail height sensor of FIG. 6B includes a height indicating member 142 which rides on the top of rail 140. Height indicating member 142 is pivotally attached by a pivot assembly 150 to the underside of frame 11 of pilot vehicle 10. The rail height sensor of FIG. 6B also includes a linear potentiometer 146 which is pivotally attached by a pivot assembly 154 to the underside of frame 11 of pilot vehicle 10. Potentiometer 146 has a rod 148 which extends therefrom and which is attached to height indicating member 142 by a bolt 152. Potentiometer 146 which is connected to computer 46 provides an electrical signal to computer 46 indicative of the changes in height of frame 11 above the top of rail 140. The electrical signals from each the potentiometers 146 of pilot vehicle 10 are then compared by computer 46 to determine whether car reference plane 82 of pilot vehicle 10 is being maintained parallel to the rail top reference tilt grid 83 for pilot vehicle 10.

Figure 6D:
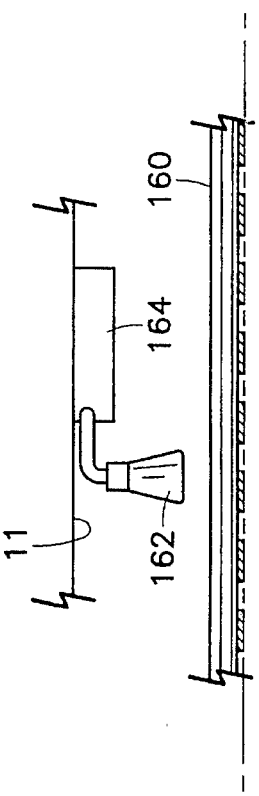

The rail height indicator of FIG. 6D includes a microwave horn 162 mounted on the underside of frame 11 of pilot vehicle 10. Microwave horn 162 directs microwave energy toward the top of rail 60. The microwave energy is reflected by rail 60 to a microwave electronics module 164 which includes a time domain reflectometer as well as a source for generating microwaves. The reflected microwave energy received by each of the time domain reflectometers within each of the four modules 164 is next used to determine whether car reference plane 82 of pilot vehicle 10 is being maintained parallel to the rail top reference tilt grid for pilot vehicle 10.

When a suspension system is used with pilot vehicle 10 the data measurements ($\Delta h^c{}_{z1}$, $\Delta h^c{}_{z2}$, $\Delta h^c{}_{z3}$, $\Delta h^c{}_{z4}$) provided by the track height sensors of FIG. 6 are employed in the following equations to determine the pitch and roll angles between the pilot vehicle reference plane 82 and the rail top reference tilt grid 83.

$$\theta^c_{\Delta h} = \tan^{-1}\left(\frac{\Delta h^c_{z1} - \Delta h^c_{z4}}{2lx} + \frac{\Delta h^c_{z2} - \Delta h^c_{z3}}{2lx}\right) \quad (28)$$

$$\phi^c_{\Delta h} = \tan^{-1}\left(\frac{\Delta h^c_{z1} - \Delta h^c_{z2}}{2ly} + \frac{\Delta h^c_{z4} - \Delta h^c_{z3}}{2ly}\right) \quad (29)$$

$$\psi^c_{\Delta h} = 0 \quad (30)$$

Angels $\theta^c_{\Delta h}$ and $\phi^c_{\Delta h}$ are used to create the following pitch roll direction cosine matrix to transform total acceleration components measured in the pilot vehicle reference plane 82 into the equivalent rail top reference tilt grid 83:

$$\begin{vmatrix} \cos\theta^c_{\Delta h} & \sin\theta^c_{\Delta h}\cos\psi^c_{\Delta h} & -\sin\theta^c_{\Delta h}\cos\psi^c_{\Delta h} \\ 0 & \cos\psi^c_{\Delta h} & \sin\psi^c_{\Delta h} \\ \sin\theta^c_{\Delta h} & -\cos\theta^c_{\Delta h}\sin\psi^c_{\Delta h} & \cos\theta^c_{\Delta h}\cos\psi^c_{\Delta h} \end{vmatrix} = \text{ref grid} \quad (31$$

It should be noted that $\Delta h^c_{z1}$ is the height measurement between plane 82 and grid 83 adjacent wheel 84, $\Delta h^c_{z2}$ is the height measurement between plane 82 and grid 83 adjacent wheel 85, $\Delta h^c_{z3}$ is the height measurement between plane 82 and grid 83 adjacent wheel 86 and $\Delta h^c_{z4}$ is the height measurement between plane 82 and grid 83 adjacent wheel 87.

Referring to FIGS. 1, 5 and 9, the three axis accelerometer 208 of the inertial platform 114 on board pilot vehicle 10 provides electrical signals $a^{c'}_{xtot}$, $a^{c'}_{ytot}$ and $a^{c'}_{ztot}$ through a filter 214 to an equation processor 228. The electrical signals a $a^{c'}_{xtot}$, $a^{c'}_{ytot}$ and $a^{c'}_{ztot}$ represent the x, y and z components of acceleration, that is the force that is exerted upon pilot vehicle 10 when pilot vehicle 10 is accelerated. The electrical signals provided by the track height sensors 102 and 104 (FIG. 5) are also supplied through a filter 216 to equation processor 228. The electrical signals provided by track height sensors 102 and 104 are indicative of the rail top to pilot vehicle reference plane measurements $\Delta h^c_{z1}$, $\Delta h^c_{z2}$, $\Delta h^c_{z3}$, $\Delta h^c_{z4}$ illustrated in FIG. 3.

Equation processor 228 processes these signals generating the pilot vehicle to rail top reference grid matrix of expression 31. The output signals $a^c_{xtot}$, $a^c_{ytot}$ and $a^c_{ztot}$ from processor 228 are supplied to equation processor 232.

The vertical rate gyro 206 of platform 114 provides the electrical signal $\dot{\theta}^c$ through a filter to equation processor 226. Equation processor 226 receives the signal $V^c_x$ from equation processor 220. Equation processor 220 generates the signal $V^c_x$, which is (V1+V2)/2, from the velocity signals V1 and V2 provided by data wheels 110. Equation processor 226 generates the signal $a^c_{zmn}$ (equation five) supplying the signal $a^c_{zmn}$ to equation processor 232. It should be noted that V1 represents the velocity of the outer track data wheel 110 and V2 represents the velocity of the inner track data wheel 110.

The signal $V^c_x$ from equation processor 220 is also supplied to equation processor 224 which generates the signal $a^c_{xmn}$ (equation six). The signal $a^c_{xmn}$ is supplied to equation processor 232.

Track gage module 202 supplies the electrical signal $d_g$ to equation processor 218 and equation processor 220 supplies the electrical signal V1–V2 processor 218. Equation processor 218 then generates the signal $\dot{\psi}^c$ (equation two) which is supplied to equation processor 230. Equation processor 230 also receives the signal $V^c_x$ from equation processor 220.

Equation processor 230 generates the signal $a^c_{ymn}$ (equation three) which is supplied to equation processor 232.

Compass 100 supplies the signal $\theta_N$ to equation processor 222 which also receives the signal $\psi_L$ from latitude location apparatus 204 and the signal $V^c_x$ from equation processor 222. Equation processor 222 then processes these signals generating the Coriolis acceleration components signals $a^c_{xcor}$, $a^c_{ycor}$ and $a^c_{zcor}$ (equations nine, ten and eleven). The signals $a^c_{xcor}$, $a^c_{ycor}$ and $a^c_{zcor}$ are supplied to equation processor 232.

Equation processor 232 generates the x, y and z acceleration vector component signals $a^c_{xgm}$, $a^c_{ygm}$ and $a^c_{zgm}$ (equation thirteen) which are supplied to equation processors 234 and 236.

Equation processor 236 processes the signals $a^c_{xgm}$, $a^c_{ygm}$ and $a^c_{zgm}$ generating the three direction cosines of equation sixteen, seventeen and eighteen.

Equation processor 234 also receives the signal $\theta_N$ from compass 100. Equation processor 234 then processor the signal $\theta_N$ along with the signals $a^c_{xgm}$, $a^c_{ygm}$ and $a^c_{zgm}$ to provide the 3×3 direction cosine matrix of matrix 24. The elements of this matrix are found in equations sixteen, seventeen, eighteen, twenty, twenty one, twenty two, twenty five, twenty six and twenty seven. The flow system 200 of FIG. 9 may be implemented using a computer program written for the pilot vehicle's on board computer 46 (FIG. 1). Each of the external components of system 200 are electrically connected to computer 46. These components include data wheels 110, compass 100, track height sensors 102 and 104, three axis accelerometer 208, vertical rate gyro 206 and latitude location apparatus 204. The track gage 202 may be stored in the memory of computer 46.

Figure 10B:
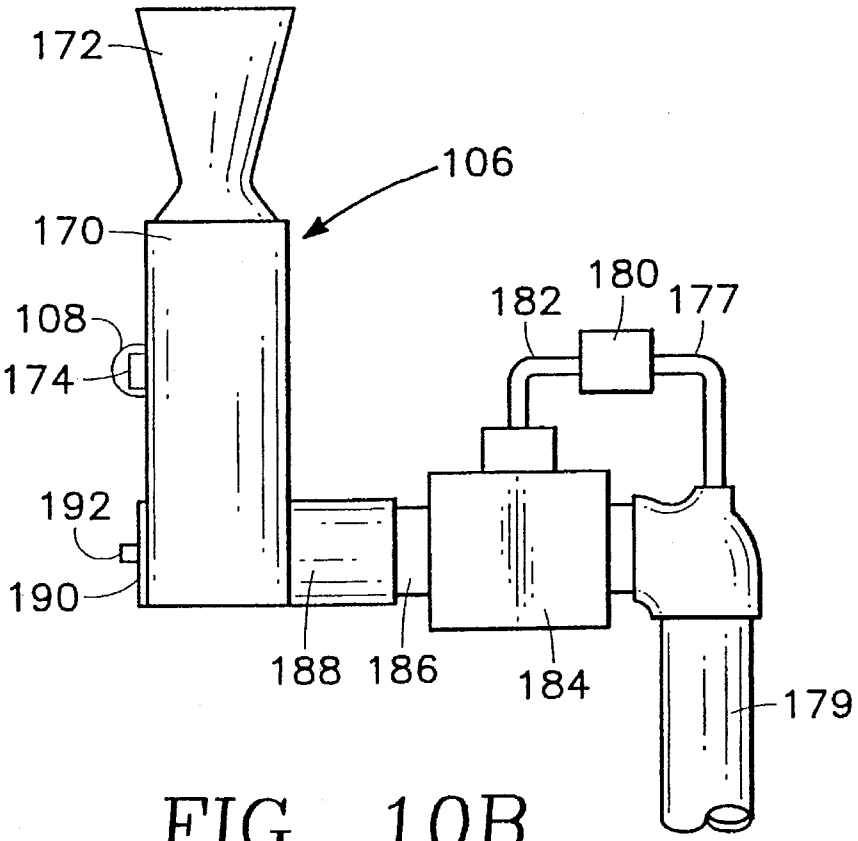
FIGS. 10A and 10B are detailed schematic diagrams of one of the pair of reaction jet stopping systems adapted for use with the pilot vehicle of FIG. 5.
Figure 10A:
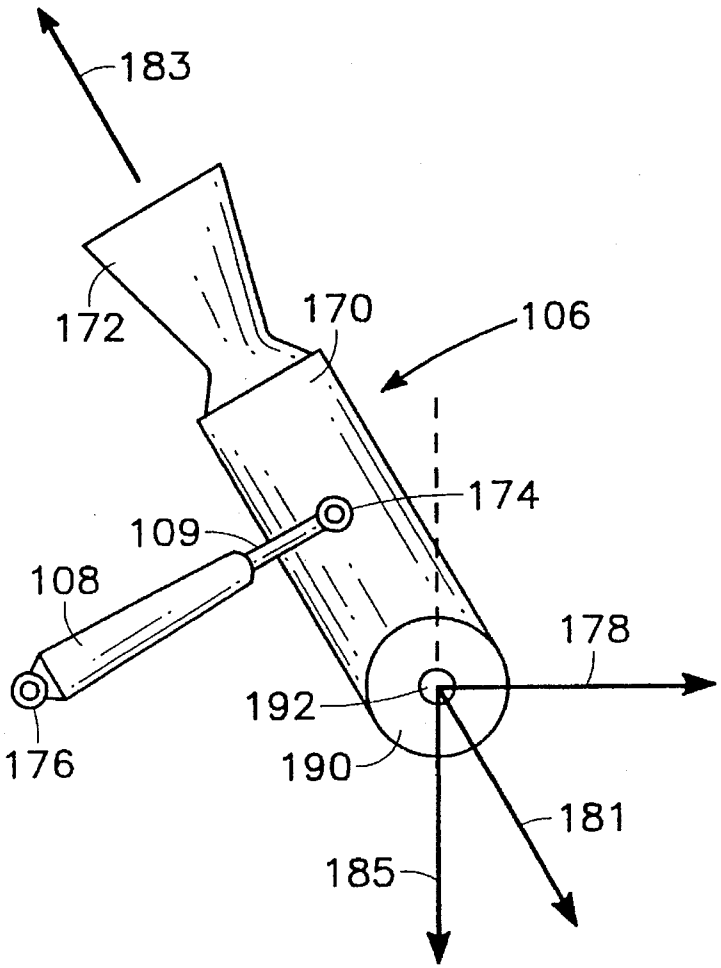

Referring now to FIGS. 5, 10A and 10B, there is shown an air jet braking system comprising a pair of reaction jet stopping systems 106 for bringing pilot vehicle to a complete stop in a relatively short distance. It should be noted that each side of pilot vehicle 10 has a reaction jet stopping system 106 pivotally mounted near the rear portion of frame 11 of pilot vehicle 10 in proximity with the rear wheels of pilot vehicle 10.

Each reaction jet stopping system 106 includes a nozzle 172 which is affixed to a constant diameter plenum 170 which receives compressed air from air storage tanks 24. The nozzle 172 of each reaction jet stopping system 106 is a converging diverging nozzle designed to accelerate the air exiting the nozzle to supersonic velocities in order to provide sufficient thrust to bring pilot vehicle to a complete and safe stop in a relative short distance (for example 5–20 feet).

As is best illustrated in FIG. 10B each reaction jet stopping system 106 includes a primary inlet pipe 179 which connects the air storage tanks 24 of pilot vehicle 10 to the inlet port of a air activated valve 184 which uses compressed air for activation. A secondary inlet pipe 177 connects pipe 179 to a solenoid valve 180 which is electrically opened by an electrical signal generated by braking electronics module 30. Braking electronics module 30, in turn, receives a digital control signal from computer 46 which indicates to braking electronics module 30 that solenoid valve 180 is to be opened.

When solenoid valve 180 opens compressed air passes through pipe 177, solenoid valve 180 and a secondary inlet pipe 182 to the activation mechanism of valve 184. This, in turn, allows compressed air from air storage tanks 24 to pass through pipe 179, air activated valve 184 and a pipe 186 to the plenum 170 of reaction jet stopping system 106.

Rotatably mounted on the outer surface of pipe 186 is a swivel fitting 188 which is affixed at one end to plenum 170. Swivel fitting 188 allows for rotational motion of plenum 170 and its associated nozzle 172 as compressed air exits nozzle 172 as indicated by the arrow 183 of FIG. 10A. Swivel fitting 188 and plenum 170 are secured to pipe 186 by a retaining rod and nut 192 and washer 190.

Referring to FIGS. 1, 5, 10A and 10B, the thrust vector or braking force 181 resulting from compressed air exiting nozzle 172 has a vertical component 185 and a horizontal component 178. It should be noted that forward motion for FIG. 10A is from right to left and the reaction jet stopping system 106 illustrated in FIG. 10A is the system 106 rotatably mounted on the left side of pilot vehicle 10. The vertical component 185 of thrust vector 181 increases the load on each wheel 58 of pilot vehicle 10 decreases the tendency of wheels 58 to break loose from the rails 70 upon which wheels 58 are riding. This, in turn, substantially deduces skidding of pilot vehicle 10 when pilot vehicle 10 is braking to avoid a hazard on rails 70. The horizontal component 178 of thrust vector 181 opposes forward motion by pilot vehicle 10 thereby assisting the braking system for pilot vehicle 10. The expelling of compressed air through nozzles 172 of each reaction jet stopping system 106 occurs over several seconds (5–50 seconds) during which time the combination of the thrust vector 181 generated by each reaction jet stopping system 106 and the braking system for pilot vehicle 10 bring pilot vehicle 10 to a complete stop.

Each reaction jet stopping system 106 also has a spring shock absorber 108 which hold system 106 in a substantially vertical position as shown in FIG. 5. The piston rod 109 of shock absorber 108 is attached to plenum 107 by a pivot bushing 174 while the cylinder of shock absorber 108 is attached to frame 11 of pilot 10 by a pivot bushing 176. Shock absorber 108 which, for example, may be an automobile shock absorber, critically dampens the angular deflection of nozzle 172 preventing over shoot of nozzle 172.

The supersonic nozzle 172 of each reaction jet stopping system 106 develops a thrust $T_{th}$ for bringing pilot vehicle 10 to a complete stop when pilot vehicle 10 encounters a hazard on tracks 70. The thrust in pounds force develop by each nozzle 172 is determined by the following equation:

$$\Gamma_{th} = A_t P_1 \sqrt{\frac{2k^2}{k-1}\left(\frac{2}{k+1}\right)^{(k+1)(k-1)}\left(1-\left(\frac{P_2}{P_1}\right)^{\frac{k-1}{k}}\right)} + (P_2 - P_3)A_2 \tag{32}$$

while the mass flow rate in pounds per second is given by the following equation:

$$Wt = A_t P_1 g k \frac{\sqrt{\left(\frac{2}{K-1}\right)^{(k+1)(k-1)}}}{\sqrt{gkRT_1}} \tag{33}$$

where:

$A_t$ is the area of the nozzle throat of nozzle 172;

k is the ratio of specific heats which is 1.4 for air;

g is the acceleration of gravity which is approximately 32.2 ft/sec$^2$;

R is the gas constant which is 53.3 for air;

$T_1$ is the temperature of the supply air;

$P_1$ is the pressure of the supply air;

$P_2$ is the static pressure at the exit from nozzle 172;

$P_3$ is the pressure of the atmosphere surrounding nozzle 172; and $A_2$ is the area of the exit plane of nozzle 172.

By using the following values in equations 32 and 33 and integrating the air weight flow rate Wt, a thrust history for the air jet braking system for pilot vehicle can be calculated:

(1) Each nozzle 172 has a one inch throat diameter and a five inch diameter at the nozzle exit.

(2) Storage tank 24 and its associated piping 179 are connected to each reaction jet stopping systems 106 and has a storage of two cubic feet.

(3) Air pressure is initially at 2000 psi gage and air temperature is initially 60 degrees fahrenheit.

Figure 11:
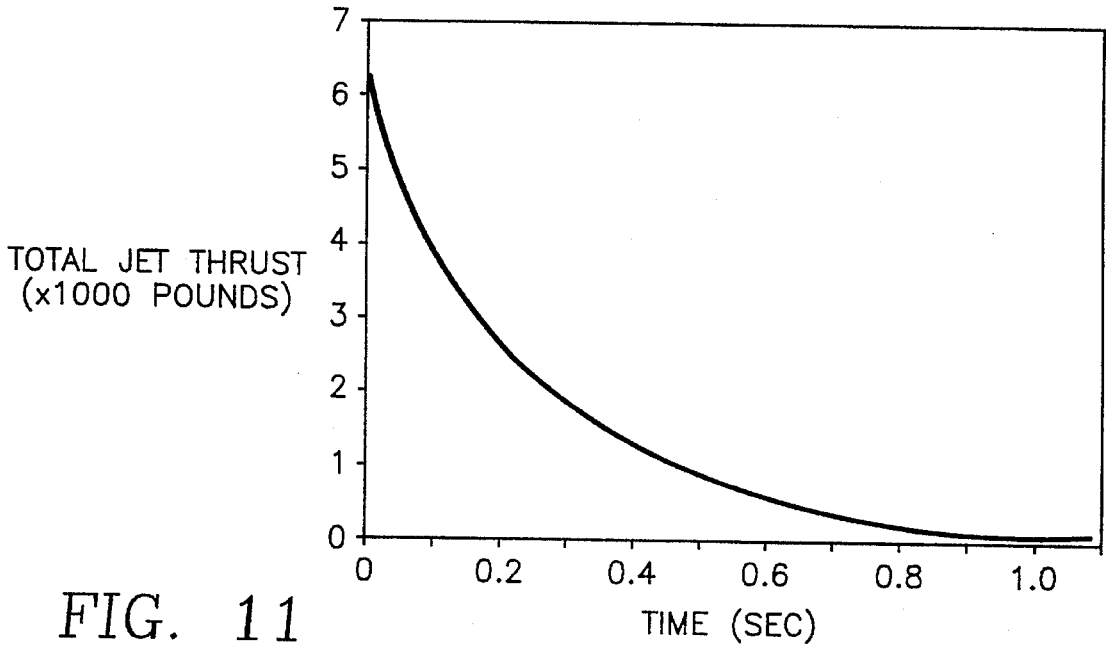
FIG. 11 is a plot of thrust versus time for the reaction jet stopping systems of FIGS. 10A and 10B.
Figure 12:
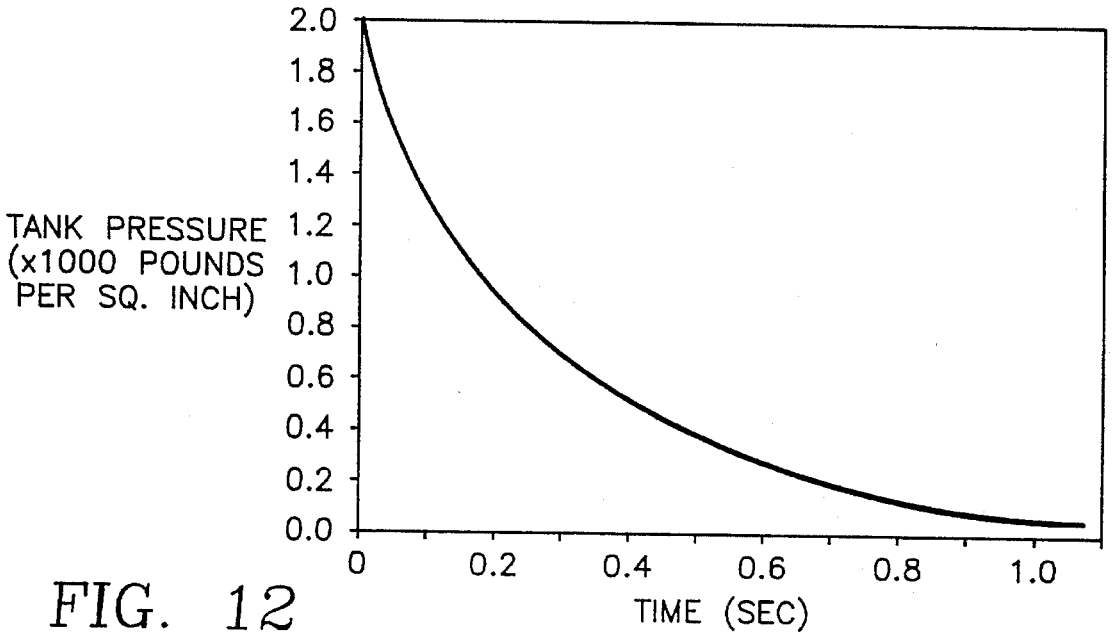
FIG. 12 is a plot 12 tank pressure versus for the air being supplied to the reaction jet stopping systems of FIGS. 10A and 10B.

Total jet thrust for the air jet braking system over time is depicted in FIG. 11, while FIG. 12 depicts the decrease in air pressure over time. Table I provides numeric values for the plots of FIGS. 11 and 12 over time. In Table I, the time scale changes from 0.005 seconds per unit 0.055 seconds per unit after time 0.1 seconds is reached. The jet moment is provided in Table I since the jet moment resists the pivoting of each nozzle 172 and also supplements the damping effect of the spring shock absorber 108 coupled to each of reaction jet stopping systems 106 illustrated in FIGS. 10A and 10B.

TABLE I

Computed Variables for FIGS. 11 and 12.

Single Jet Nozzle Throat Diameter (in): 1
Number of Jet Nozzles: 2
Initial Plenum Gage Pressure, $P_1$ (psi) = 2000
Storage Volume of Tank & Piping (ft$^3$) = 2
Ratio of Specific Heats (K) used = 1.302 (polytropic if K < 1.4 for air)
Initial Thrust = 6203.585 (lb)
Initial Weight Flow Rate = 71.9862 (lbm/sec)
Initial Weight of Air in Tank = 20.93497 (lbs)
Initial Jet Exhaust Velocity = 2772.673 (ft/sec)

| Time | Air Wgt | $P_1$ | Thrust | $T_1$ | Tot Imp | Jet Mom |
|---|---|---|---|---|---|---|
| 0.005 | 20.222 | 1925.856 | 5929.979 | 54.589 | 90.993 | 5929.979 |
| 0.015 | 19.537 | 1841.366 | 5669.780 | 49.262 | 148.333 | 5669.780 |
| 0.025 | 18.879 | 1760.996 | 5422.267 | 44.017 | 203.167 | 5422.268 |
| 0.035 | 18.246 | 1684.524 | 5186.759 | 38.854 | 255.616 | 5186.759 |
| 0.045 | 17.638 | 1611.744 | 4962.617 | 33.769 | 305.796 | 4962.617 |
| 0.055 | 17.052 | 1542.458 | 4749.237 | 28.762 | 353.815 | 4749.237 |
| 0.065 | 16.489 | 1476.483 | 4546.052 | 23.832 | 399.777 | 4546.052 |
| 0.075 | 15.947 | 1413.644 | 4352.522 | 18.975 | 443.780 | 4352.522 |
| 0.085 | 15.426 | 1353.779 | 4168.147 | 14.192 | 485.917 | 4168.147 |
| 0.095 | 14.924 | 1296.731 | 3992.451 | 9.480 | 526.276 | 3992.450 |
| 0.150 | 12.479 | 1027.220 | 3162.371 | −15.218 | 719.977 | 3162.371 |
| 0.205 | 10.484 | 818.773 | 2520.310 | −38.013 | 873.907 | 2520.310 |
| 0.260 | 8.848 | 656.463 | 2020.300 | −59.093 | 996.964 | 2020.300 |
| 0.315 | 7.499 | 529.267 | 1628.391 | −78.629 | 1095.896 | 1628.391 |
| 0.370 | 6.381 | 428.982 | 1319.316 | −96.767 | 1175.856 | 1319.316 |
| 0.425 | 5.452 | 349.454 | 1074.128 | −113.638 | 1240.808 | 1074.128 |

TABLE I-continued

Computed Variables for FIGS. 11 and 12.
Single Jet Nozzle Throat Diameter (in): 1
Number of Jet Nozzles: 2
Initial Plenum Gage Pressure, $P_1$ (psi) = 2000
Storage Volume of Tank & Piping ($ft^3$) = 2
Ratio of Specific Heats (K) used = 1.302 (polytropic if K < 1.4 for air)
Initial Thrust = 6203.585 (lb)
Initial Weight Flow Rate = 71.9862 (lbm/sec)
Initial Weight of Air in Tank = 20.93497 (lbs)
Initial Jet Exhaust Velocity = 2772.673 (ft/sec)

| Time | Air Wgt | $P_1$ | Thrust | $T_1$ | Tot Imp | Jet Mom |
|---|---|---|---|---|---|---|
| 0.480 | 4.674 | 286.040 | 878.518 | −129.357 | 1293.818 | 878.518 |
| 0.535 | 4.022 | 235.208 | 721.608 | −144.027 | 1337.274 | 721.608 |
| 0.590 | 3.473 | 194.258 | 595.075 | −157.740 | 1373.045 | 595.075 |
| 0.645 | 3.008 | 161.109 | 492.511 | −170.577 | 1402.600 | 492.511 |
| 0.700 | 2.613 | 134.153 | 408.951 | −182.612 | 1427.105 | 408.951 |
| 0.755 | 2.277 | 112.137 | 340.529 | −193.909 | 1447.483 | 340.529 |
| 0.810 | 1.990 | 94.078 | 284.215 | −204.529 | 1464.474 | 284.215 |
| 0.865 | 1.743 | 79.207 | 237.623 | −214.524 | 1478.668 | 237.623 |
| 0.920 | 1.532 | 66.913 | 198.862 | −223.942 | 1490.543 | 198.861 |
| 0.975 | 1.349 | 56.712 | 166.422 | −232.828 | 1500.481 | 166.422 |
| 1.030 | 1.191 | 48.217 | 139.093 | −241.220 | 1508.793 | 139.093 |
| 1.085 | 1.054 | 41.118 | 115.893 | −249.154 | 1515.731 | 115.893 |

From the foregoing, it may readily be seen that the present invention comprises a new, unique and exceedingly useful pilot vehicle which is useful for monitoring hazardous conditions on railroad tracks and which constitutes a considerable improvement over the known prior art. Obviously many modifications and variations of the present invention are possible in light of the above teachings. It is therefore to be understood that within the scope of the appended claims the invention may be practiced otherwise than as specifically described.

APPENDIX A

| Symbols | Definitions |
|---|---|
| Abs | Absolute Value. |
| $A_g^c$ | Acceleration vector in pilot vehicle coordinate system opposite gravity. |
| $A_{gm}^c$ | Acceleration vector in the gravity magnetic north coordinate system used to compute Coriolos acceleration. |
| $A_{tot}^c$ | Total acceleration vector in pilot vehicle coordinate system which is equal to the sum of all accelerations sensed by the pilot vehicle's accelerometers. |
| $A_{mn}^c$ | Total motion caused acceleration vector in pilot vehicle coordinate system. |
| $a_{xcor}^c$ | Coriolis acceleration normal to pilot vehicle's x axis. |
| $a_{ycor}^c$ | Coriolis acceleration along pilot vehicle's y axis. |
| $a_{zcor}^c$ | Coriolis acceleration along pilot vehicle's z axis. |
| $a_{xg}^c$ | Acceleration due to gravity along pilot vehicle's x axis. |
| $a_{yg}^c$ | Acceleration due to gravity along pilot vehicle's y axis. |
| $a_{zg}^c$ | Acceleration due to gravity along pilot vehicle's z axis. |
| $a_{xmn}^c$ | Motion caused longitudinal acceleration along pilot vehicle's x axis. |
| $a_{ymn}^{c'}$ | Motion caused lateral acceleration along pilot vehicle's y axis from differential wheel speeds. |
| $a_{ymn}^{c'}$ | Motion caused lateral acceleration along pilot vehicle's y axis from differential wheel speeds plus Coriolos acceleration. |
| $a_{zmn}^c$ | Motion caused lateral acceleration along pilot vehicle's z axis from a vertical pull up. |
| $\Delta h_{z1}^c$ | Height from rail top to pilot vehicle's reference plane at the front left corner of pilot vehicle. |

APPENDIX A-continued

| Symbols | Definitions |
|---|---|
| $\Delta h_{z2}^c$ | Height from rail top to pilot vehicle's reference plane at the front right corner of pilot vehicle. |
| $\Delta h_{z3}^c$ | Height from rail top to pilot vehicle's reference plane at the rear right corner of pilot vehicle. |
| $\Delta h_{z4}^c$ | Height from rail top to pilot vehicle's reference plane at the rear left corner of pilot vehicle. |
| $d_g$ | Track gage. |
| N | Unit vector for north direction in pilot vehicle's x–y plane. |
| $\omega_e$ | Earth's rate of rotation about its axis. |
| $\phi_{\Delta h}^c$ | Roll angle between the pilot vehicle's reference plane and the rail top reference tilt grid. |
| $\psi_{66h}^c$ | Yaw angle between the pilot vehicle's reference plane x axis and the direction of the rails. |
| $\psi$ | Yaw rate of pilot vehicle. |
| $\psi_L$ | Degrees latitude of pilot vehicle. |
| $\dot{\rho}$ | Pilot vehicle velocity vector in earth centered coordinate system. |
| $R_{tz}$ | Radius of turn of tracks in horizontal and vertical planes. |
| $\theta^c$ | Pitch rate of pilot vehicle. |
| $\theta_N$ | Angle from pilot vehicle's x axis of North in pilot vehicle's x y plane. |
| $\theta_{\Delta h}^c$ | Pitch angle difference between the pilot vehicle reference plane and the rail top reference tilt grid. |
| V1 | Velocity of outer track data wheel during a lateral turn. |
| V2 | Velocity of inner track data wheel during a lateral turn. |
| $\zeta$ | Angle between North unit vector in pilot vehicle's x y plane and the pilot vehicle's $z^c$ axis. |
| $1_x^c$ | Unit vector along pilot vehicle's x axis. |
| $1_y^c$ | Unit vector along pilot vehicle's y axis. |
| $1_z^c$ | Unit vector along pilot vehicle's z axis. |
| $1_{xg}$ | Unit vector along local level x axis. |
| $1_{yg}$ | Unit vector along local level y axis. |
| $1_{zg}$ | Unit vector along local level z axis. |
| $1_{xgm}$ | Unit vector along gravity magnetic north x axis. |
| $1_{ygm}$ | Unit vector along gravity magnetic north y axis. |
| $1_{zgm}$ | Unit vector along gravity magnetic north z axis. |
| $A_t$ | The area of the nozzle throat. |
| k | The ratio of specific heats which is 1.4 for air. |
| g | The acceleration of gravity which is approximately |

APPENDIX A-continued

| Symbols | Definitions |
|---|---|
| | 32.2 ft/sec$^2$. |
| R | The gas constant which is 53.3 for air. |
| $T_1$ | The temperature of the supply air. |
| $P_1$ | The pressure of the supply air. |
| $P_2$ | The static pressure at the exit from the nozzle. |
| $P_3$ | The pressure of the atmosphere surrounding the nozzle. |
| $A_2$ | The area of the exit plane of the nozzle. |

What is claimed is:

1. A pilot vehicle for surveying railway tracks ahead of a train, said pilot vehicle traveling along said railway tracks ahead of said train, said pilot vehicle comprising:

drive means for propelling said pilot vehicle along said railway tracks;

processing means for receiving position information and control signals transmitted by said train, said processing means processing said position information and control signals to determine a safe distance said pilot vehicle is to be disposed ahead of said train;

drive control means operatively connected to said processing means and said drive means for maintaining said pilot vehicle at said safe distance ahead of said train;

television camera means mounted on said pilot vehicle at a front end of said pilot vehicle, said television camera means monitoring a visual scene presented to said pilot vehicle as said pilot vehicle travels along said railway tracks, said television camera means generating a video signal representative of said visual scene presented to said pilot vehicle as said pilot vehicle travels along said railway tracks;

transmitter/receiver means connected to said television camera means to receive said video signal from said television camera means, said transmitter/receiver means including modulating means for modulating a first radio frequency signal responsive to said video signal and an antenna for transmitting said first radio frequency signal to said train;

magnetic signature sensing means mounted on an underside of said pilot vehicle in proximity with a pair of rails of said railway tracks, said magnetic signature sensing means measuring a magnetic field generated by a current flowing through at least one of said pair of rails of said railway track, said magnetic signature sensing means generating a first electrical signal proportional to an intensity of said magnetic field;

said processing means receiving said first electrical signal from said magnetic signature sensing means, said processing means generating a warning message whenever a voltage level of said first electrical signal decreases below a predetermined voltage level;

said modulating means modulating a second radio frequency signal responsive to said warning message;

said antenna transmitting said second radio frequency signal to said train;

orientation monitoring means positioned on said pilot vehicle for monitoring an orientation of said pilot vehicle with respect to the direction of the force of gravity of the earth;

said processing means generating a second electrical signal;

braking means connected to said processing means to receive said second electrical signal, said braking means, responsive to said second electrical signal bringing said pilot vehicle to an immediate stop.

2. The system of claim 1 wherein said processing means comprises a digital computer.

3. The system of claim 1 wherein said braking means comprises a pair of reaction jet stopping systems for expelling a compressed gas into the atmosphere to bring said pilot vehicle to said immediate stop, a first of said pair of reaction jet stopping systems being pivotally mounted on one side of said pilot vehicle and a second of said pair of reaction jet stopping systems being pivotally mounted on an opposite side of said pilot vehicle.

4. The system of claim 3 wherein each of said pair of reaction jet stopping systems comprises:

a source of said compressed gas;

a normally closed solenoid valve having an inlet port connected to said source of compressed gas, an electrical activation port connected to said processing means to receive said second electrical signal and an outlet port;

a normally closed air activated valve having an inlet port connected to said source of compressed gas, an air activation port connected to the outlet port of said normally closed solenoid valve and an outlet port; and a nozzle having plenum the plenum of said nozzle having a swivel fitting affixed thereto, said swivel fitting being pivotally coupled to the outlet port of said air activated valve to allow for rotational movement of said nozzle;

said normally closed solenoid valve being opened by said second electrical signal to allow said compressed air to pass through said normally closed solenoid valve to the air activation port of said normally closed air activated valve activating said normally closed air activated valve;

said normally closed air activated valve when activated allowing said compressed air to pass through said normally closed air activated valve and said plenum to said nozzle;

said nozzle expelling said compressed air to generate a rearward braking force opposing a forward direction of movement of said pilot vehicle.

5. The system of claim 1 wherein said orientation means includes a three axis accelerometer mounted on said pilot vehicle, said three axis accelerometer generating $a^{c'}_{xtot}$, $a^{c'}_{ytot}$ and $a^{c'}_{ztot}$ electrical signals representative of x, y and z components of acceleration for said pilot vehicle when said pilot vehicle accelerates, said three axis accelerometer being connected to said digital computer to provide said $a^{c'}_{xtot}$, $a^{c'}_{ytot}$ and $a^{c'}_{ztot}$ electrical signals to said digital computer.

6. The system of claim 1 wherein said orientation means includes a vertical rate gyro mounted on said pilot vehicle, said vertical rate gyro generating a $\theta^c$ electrical signal representative of a pitch rate for said pilot vehicle, said vertical rate gyro being connected to said digital computer to provide said $\theta^c$ electrical signal to said digital computer.

7. The system of claim 1 wherein said orientation means includes a track gage module located on said pilot vehicle representative of a track gage for said railway tracks, said track gage module generating a $d_g$ electrical signal, said track gage module being connected to said digital computer to provide said $d_g$ electrical signal to said digital computer.

8. The system of claim 1 wherein said orientation means includes a pair of data wheels positioned on the underside of said pilot vehicle to engage the pair of rails of said railway tracks, said data wheels generating a V1 electrical signal representative of the velocity of an outer track data wheel of said pair of data wheels and a V2 electrical signal representative of the velocity of an inner track data wheel of said pair of data wheels, said pair of data wheels being connected to said digital computer to provide said V1 electrical signal and said V2 electrical signal to said digital computer.

9. The system of claim 1 wherein said orientation means includes a latitude location apparatus mounted on said pilot vehicle, said latitude location apparatus generating an $\psi_L$ electrical signal representative of a latitiude for a section of said railway tracks upon which said pilot vehicle is currently traveling, said latitude location apparatus being connected to said digital computer to provide said $\psi_L$ electrical signal to said digital computer.

10. The system of claim 9 wherein said latitude location appartus comprises a global positioning system.

11. The system of claim 1 wherein said orientation means includes a magnetic compass mounted on said pilot vehcile, said magnetic compass generating a $\theta_N$ electrical signal representative of an angle of a track heading for said railway tracks relative to true north, said magnetic compass being connected to said digital computer to provide said $\theta_N$ electrical signal to said digital computer.

12. The system of claim 1 where said television camera means comprises a video camera.

13. A pilot vehicle for surveying railway tracks ahead of a train, said pilot vehicle traveling along said railway tracks ahead of said train, said pilot vehicle comprising:

drive means for propelling said pilot vehicle along said railway tracks;

a digital computer for receiving position information and control signals transmitted by said train, said digital computer processing said position information and control signals to determine a safe distance said pilot vehicle is to be disposed ahead of said train;

drive control means operatively connected to said digital computer and said drive means for maintaining said pilot vehicle at said safe distance ahead of said train;

a video camera mounted on said pilot vehicle at a front end of said pilot vehicle, said video camera monitoring a visual scene presented to said pilot vehicle as said pilot vehicle travels along said railway tracks, said video camera generating a video signal representative of said visual scene presented to said pilot vehicle as said pilot vehicle travels along said railway tracks;

a transmitter/receiver module connected to said video camera to receive said video signal from said video camera, said transmitter/receiver module including a modulator for modulating a first radio frequency signal responsive to said video signal and an antenna for transmitting said first radio frequency signal to said train;

a magnetic signature sensing system mounted on an underside of said pilot vehicle in proximity with a pair of rails of said railway tracks, said magnetic signature sensing system measuring a magnetic field generated by a current flowing through at least one of said pair of rails of said railway track, said magnetic signature sensing system generating a first electrical signal proportional to an intensity of said magnetic field;

said digital computer receiving said first electrical signal from said magnetic signature sensing system, said digital computer generating a warning message signal whenever a voltage level of said first electrical signal decreases below a predetermined voltage level;

said modulator modulating a second radio frequency signal responsive to said warning message signal;

said antenna transmitting said second radio frequency signal to said train;

orientation monitoring means positioned on said pilot vehicle for monitoring an orientation of said pilot vehicle with respect to the direction of the force of gravity of the earth;

said digital computer generating a second electrical signal;

braking means connected to said digital computer to receive said second electrical signal, said braking means, responsive to said second electrical signal bringing said pilot vehicle to an immediate stop;

said braking means including a pair of reaction jet stopping systems for expelling a compressed gas into the atmosphere to bring said pilot vehicle to said immediate stop, a first of said pair of reaction jet stopping systems being pivotally mounted on one side of said pilot vehicle and a second of said pair of reaction jet stopping systems being pivotally mounted on an opposite side of said pilot vehicle;

each of said pair of reaction jet stopping systems comprising:

a source of said compressed gas;

a normally closed solenoid valve having an inlet port connected to said source of compressed gas, an electrical activation port connected to said digital computer to receive said second electrical signal and an outlet port;

a normally closed air activated valve having an inlet port connected to said source of compressed gas, an air activation port connected to the outlet port of said normally closed solenoid valve and an outlet port; and a nozzle having plenum the plenum of said nozzle having a swivel fitting affixed thereto, said swivel fitting being pivotally coupled to the outlet port of said air activated valve to allow for rotational movement of said nozzle;

said normally closed solenoid valve being opened by said second electrical signal to allow said compressed air to pass through said normally closed solenoid valve to the air activation port of said normally closed air activated valve activating said normally closed air activated valve;

said normally closed air activated valve when activated allowing said compressed air to pass through said normally closed air activated valve and said plenum to said nozzle;

said nozzle expelling said compressed air to generate a rearward braking force opposing a forward direction of movement of said pilot vehicle.

14. The system of claim 13 wherein said orientation means includes a three axis accelerometer positioned on said pilot vehicle, said three axis accelerometer generating $a^{c'}_{xtot}$, $a^{c'}_{ytot}$ and $a^{c'}_{ztot}$ electrical signals representative of x, y and z components of acceleration for said pilot vehicle when said pilot vehicle accelerates, said three axis accelerometer being connected to said digital computer to provide said $a^{c'}_{xtot}$, $a^{c'}_{ytot}$ and $a^{c'}_{ztot}$ electrical signals to said digigtal computer.

15. The system of claim 13 wherein said orientation means includes a vertical rate gyro mounted on said pilot vehicle, said vertical rate gyro generating a $\theta^c$ electrical signal representative of a pitch rate for said pilot vehicle, said vertical rate gyro being connected to said digital computer to provide said $\theta^c$ electrical signal to said digital computer.

16. The system of claim 13 wherein said orientation means includes a track gage module located on said pilot vehicle, said track gage module generating a $d_g$ electrical signal representative of a track gage for said railway tracks, said track gage module being connected to said digital computer to provide said $d_g$ electrical signal to said digital computer.

17. The system of claim 13 wherein said orientation means includes a pair of data whees positioned on the underside of said pilot vehicle to engage the pair of rails of said railway tracks, said data wheels generating a V1 electrical signal representative of the velocity of an outer track data wheel of said pair of data wheels and a V2 electrical signal representative of the velocity of an inner track data wheel of said pair of data wheels, said pair of data wheels being connected to said digital computer to provide said V1 electrical signal and said V2 electrical signal to sid digital computer.

18. The system of claim 13 wherein said orientation means includes a latitude location apparatus mounted on said pilot vehicle, said latitude location apparatus generating an $\psi_L$ electrical signal representative of a latitiude for a section of said railway tracks upon which said pilot vehicle is currently traveling, said latitude location apparatus being connected to said digital computer to provide said $\psi_L$ electrical signal to said digital computer.

19. The system of claim 18 wherein said latitude location appartus comprises a global positioning system.

20. The system of claim 13 wherein said orientation means includes a magnetic compass mounted on said pilot vehcile, said magnetic compass generating a $\theta_N$ electrical signal representative of an angle of a track heading for said railway tracks relative to true north, said magnetic compass being connected to said digital computer to provide said $\theta_N$ electrical signal to said digital computer.

* * * * *